US011735101B2

(12) United States Patent
Huang et al.

(10) Patent No.: US 11,735,101 B2
(45) Date of Patent: Aug. 22, 2023

(54) ELECTRONIC SUBSTRATE AND DRIVING METHOD THEREOF, AND DISPLAY DEVICE

(71) Applicants: BOE MLED Technology Co., Ltd., Beijing (CN); BOE Technology Group Co., Ltd., Beijing (CN)

(72) Inventors: Wenchieh Huang, Beijing (CN); Lingyun Shi, Beijing (CN); Ming Chen, Beijing (CN); Xue Dong, Beijing (CN)

(73) Assignees: BOE MLED Technology Co., Ltd., Beijing (CN); BOE Technology Group Co., Ltd., Beijing (CN)

( * ) Notice: Subject to any disclaimer, the term of this patent is extended or adjusted under 35 U.S.C. 154(b) by 211 days.

(21) Appl. No.: 17/290,146

(22) PCT Filed: Sep. 10, 2020

(86) PCT No.: PCT/CN2020/114468
§ 371 (c)(1),
(2) Date: Apr. 29, 2021

(87) PCT Pub. No.: WO2021/082756
PCT Pub. Date: May 6, 2021

(65) Prior Publication Data

US 2022/0309996 A1 Sep. 29, 2022

(30) Foreign Application Priority Data

Oct. 31, 2019 (CN) ..... 201911053039.9

(51) Int. Cl.
*G09G 3/32* (2016.01)

(52) U.S. Cl.
CPC ..... *G09G 3/32* (2013.01); *G09G 2300/0408* (2013.01); *G09G 2310/0286* (2013.01);
(Continued)

(58) Field of Classification Search
CPC ..... G09G 3/32; G09G 2300/0408; G09G 2310/0286; G09G 2320/0223;
(Continued)

(56) References Cited

U.S. PATENT DOCUMENTS 10,026,358 B2 7/2018 He et al.
10,614,762 B2 4/2020 Kim et al.
(Continued)

FOREIGN PATENT DOCUMENTS

CN 101051442 A 10/2007
CN 101738794 A 6/2010
(Continued)

OTHER PUBLICATIONS

Sep. 3, 2021 (CN) First Office Action Appn 201911053039.9 with English Translation.

*Primary Examiner* — Muhammad N Edun
(74) *Attorney, Agent, or Firm* — Banner & Witcoff, Ltd.

(57) ABSTRACT

An electronic substrate and a driving method thereof, and a display device. The electronic substrate includes a pixel drive chip which includes at least one signal terminal, a signal generation circuit, a data storage circuit, and an output circuit; at least one signal terminal is configured to be electrically connected to the light-emitting element; the signal generation circuit is connected to at least one signal terminal and configured to receive an input signal through the at least one signal terminal and generate a clock signal according to the input signal; the data storage circuit is configured to receive the clock signal and store the input signal according to the clock signal; and the output circuit is configured to output a current, which is generated according to the stored input signal and used for driving the light-emitting element, though at least one signal terminal.

17 Claims, 14 Drawing Sheets

(52) U.S. Cl.
CPC . *G09G 2310/0297* (2013.01); *G09G 2310/08* (2013.01); *G09G 2320/0223* (2013.01); *G09G 2330/026* (2013.01)

(58) Field of Classification Search
CPC ..... G09G 2310/0297; G09G 2310/08; G09G 3/2088; G09G 2330/026
See application file for complete search history.

(56) References Cited

U.S. PATENT DOCUMENTS

| | | | | |
|---|---|---|---|---|
| 2007/0236421 | A1 | 10/2007 | Shin | |
| 2008/0284312 | A1 | 11/2008 | Kimura | |
| 2013/0106489 | A1 | 5/2013 | Zhang et al. | |
| 2014/0139414 | A1 | 5/2014 | Zhang | |
| 2015/0077008 | A1* | 3/2015 | Hsu | G09G 3/3233 315/224 |
| 2016/0063957 | A1* | 3/2016 | Shirasaki | G11C 19/28 345/213 |
| 2016/0125821 | A1* | 5/2016 | Lee | G09G 3/3688 345/92 |
| 2017/0011703 | A1* | 1/2017 | Higuchi | G09G 3/3674 |
| 2019/0206324 | A1 | 7/2019 | Kim et al. | |

FOREIGN PATENT DOCUMENTS

| | | | |
|---|---|---|---|
| CN | 102879962 | A | 1/2013 |
| CN | 103078624 | A | 5/2013 |
| CN | 104464667 | A | 3/2015 |
| CN | 104735387 | A | 6/2015 |
| CN | 105513536 | A | 4/2016 |
| CN | 106531045 | A | 3/2017 |
| CN | 109166529 | A | 1/2019 |
| CN | 109817181 | A | 5/2019 |
| CN | 109994076 | A | 7/2019 |
| CN | 110010059 | A | 7/2019 |
| CN | 110010093 | A | 7/2019 |
| JP | 2000196962 | A | 7/2000 |
| JP | 2000340778 | A | 12/2000 |

* cited by examiner

ELECTRONIC SUBSTRATE AND DRIVING METHOD THEREOF, AND DISPLAY DEVICE

CROSS-REFERENCE TO RELATED APPLICATION

The application is a U.S. National Phase Entry of International Application PCT/CN2020/114468 filed on Sep. 10, 2020, designating the United States of America and claiming priority to Chinese Patent Application No. 201911053039.9, filed on Oct. 31, 2019. The present application claims priority to and the benefit of the above-identified applications and the above-identified applications are incorporated by reference herein in their entirety.

TECHNICAL FIELD

The embodiments of the present disclosure relate to an electronic substrate and a driving method thereof, and a display device.

BACKGROUND

Mini LED (Mini Light-emitting Diode), also known as "sub-millimeter light-emitting diode", refers to an LED with a grain size of about 100 microns or less. The grain size of the Mini LED is between a size of a traditional LED and a size of a Micro LED (micro light-emitting diode), simply put, the Mini LED is an improved version based on traditional LED backlight.

In terms of manufacturing process, compared with the Micro LED, the Mini LED has the advantages of high yield, special-shaped cutting characteristics, etc. The Mini LED with a flexible substrate can also achieve a high-curved backlight display mode, and then adopt a local dimming design, which can have better color rendering (refers to the evaluation of the quality of the visual effect of the color in the case where the light source illuminates the object), in the case where the Mini LED is used as a backlight light source of a liquid crystal panel, the Mini LED can realize more fine HDR partitions of the liquid crystal panel, and the thickness is also close to OLED (organic light-emitting display), the Mini LED can save up to 80% of power, and therefore, with the demands of power saving, thinness, HDR, special-shaped displays, and other backlight applications, the Mini LED is widely used in products, such as mobile phones, televisions, car panels, gaming laptops, and the like.

SUMMARY

At least one embodiment of the present disclosure discloses an electronic substrate comprising a pixel drive chip which comprises at least one signal terminal, a signal generation circuit, a data storage circuit, and an output circuit; the at least one signal terminal is configured to be electrically connected to a light-emitting element; the signal generation circuit is connected to the at least one signal terminal, and is configured to receive an input signal through the at least one signal terminal and generate a clock signal according to the input signal; the data storage circuit is connected to the signal generation circuit and the output circuit, and is configured to receive the clock signal and store the input signal according to the clock signal; and the output circuit is configured to output a current, which is generated according to the input signal stored and used for driving the light-emitting element, through the at least one signal terminal.

For example, in the electronic substrate provided by at least one embodiment of the present disclosure, the signal generation circuit is further configured to generate a data delay signal according to the input signal, generate a data enable signal according to a difference between the data delay signal and the input signal, and generate the clock signal according to the data enable signal.

For example, in the electronic substrate provided by at least one embodiment of the present disclosure, the data storage circuit comprises a latch and a shift register; the latch is connected to the signal generation circuit and is configured to store the input signal and the data enable signal; and the shift register is connected to the latch and the output circuit, and is configured to shift and store the input signal according to the clock signal.

For example, in the electronic substrate provided by at least one embodiment of the present disclosure, a level of the input signal, a level of the data enable signal, and a level of the clock signal are higher than a bias voltage of a data signal and a bias voltage of a first power supply voltage.

For example, in the electronic substrate provided by at least one embodiment of the present disclosure, the input signal further comprises the first power supply voltage for driving the pixel drive chip.

For example, in the electronic substrate provided by at least one embodiment of the present disclosure, the at least one signal terminal comprises only a first signal terminal, the first signal terminal is connected to the light-emitting element, and the pixel drive chip further comprises a multiplexing circuit; and the multiplexing circuit is connected to the first signal terminal, the signal generation circuit, and the output circuit, and is configured to: in a first period, connect the first signal terminal to the signal generation circuit to provide the input signal, and in a second period, connect the first signal terminal to the output circuit to output the current to the light-emitting element.

For example, in the electronic substrate provided by at least one embodiment of the present disclosure, the at least one signal terminal comprises a first signal terminal and a second signal terminal; the first signal terminal is connected to the signal generation circuit to provide the input signal to the signal generation circuit; and the second signal terminal is connected to the output circuit and the light-emitting element to output the current output by the output circuit to the light-emitting element.

For example, the electronic substrate provided by at least one embodiment of the present disclosure further comprises: a first switch control line, a data line, and a switch control circuit; the switch control circuit is connected to the first switch control line, the data line, and the first signal terminal, and is configured to transmit the input signal provided by the data line to the first signal terminal in response to a first switch control signal provided by the first switch control line.

For example, in the electronic substrate provided by at least one embodiment of the present disclosure, the switch control circuit comprises a switch transistor; and a gate electrode of the switch transistor is connected to the first switch control line to receive the first switch control signal, a first electrode of the switch transistor is connected to the data line to receive the input signal, and a second electrode of the switch transistor is connected to the first signal terminal.

For example, the electronic substrate provided by at least one embodiment of the present disclosure further comprises: a second switch control line; the second switch control line is connected to the first signal terminal and the switch control circuit, so as to provide the first signal terminal with a second switch control signal, which is opposite to the first switch control signal, as the first power supply voltage in a case where the switch control circuit is turned off.

For example, in the electronic substrate provided by at least one embodiment of the present disclosure, the pixel drive chip further comprises a third signal terminal, and the third signal terminal is configured to provide the first power supply voltage to the pixel drive chip.

For example, in the electronic substrate provided by at least one embodiment of the present disclosure, the pixel drive chip further comprises a fourth signal terminal, and the fourth signal terminal is configured to provide a second power supply voltage to the pixel drive chip, and the second power supply voltage is opposite to the first power supply voltage.

At least one embodiment of the present disclosure also provides a display device, which comprises the electronic substrate provided by any embodiment of the disclosure, a gate drive circuit, and a data drive circuit; the gate drive circuit is configured to provide a scan signal to the electronic substrate; and the data drive circuit is configured to provide the input signal to the electronic substrate.

For example, in the display device provided by at least one embodiment of the present disclosure, the electronic substrate further comprises a backlight unit, the backlight unit comprises a plurality of backlight partitions and is driven by a local dimming method, and each of the plurality of backlight partitions comprises the pixel drive chip and the light-emitting element.

At least one embodiment of the present disclosure also provides a driving method of the electronic substrate, which comprises: receiving the input signal through the at least one signal terminal of the pixel drive chip, and generating the clock signal according to the input signal; storing the input signal according to the clock signal; and outputting the current, which is generated according to the input signal stored and used for driving the light-emitting element, through the at least one signal terminal.

For example, in the driving method of the electronic substrate provided by at least one embodiment of the present disclosure, generating the clock signal according to the input signal, comprises: generating a data delay signal according to the input signal received, generating a data enable signal according to a difference between the data delay signal and the input signal, and determining the clock signal according to the data enable signal.

For example, in the driving method of the electronic substrate provided by at least one embodiment of the present disclosure, the at least one signal terminal only comprises a first signal terminal, the first signal terminal is connected to the light-emitting element, and the driving method further comprises: in a first period, by the first signal terminal, providing the input signal to the signal generation circuit, and in a second period, by the first signal terminal, outputting the current generated by the output circuit to the light-emitting element.

BRIEF DESCRIPTION OF THE DRAWINGS

In order to clearly illustrate the technical solutions of the embodiments of the present disclosure, the drawings of the embodiments will be briefly described in the following; it is obvious that the described drawings are only related to some embodiments of the present disclosure and thus are not limitative to the present disclosure.

DETAILED DESCRIPTION

In order to make objects, technical solutions, and advantages of the embodiments of the present disclosure apparent, the technical solutions of the embodiments of the present disclosure will be described in a clearly and fully understandable way in connection with the drawings related to the embodiments of the present disclosure. Apparently, the described embodiments are just a part but not all of the embodiments of the present disclosure. Based on the described embodiments of the present disclosure, those skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only configured to indicate relative position relationship, and when the position of the object which is described is changed, the relative position relationship may be changed accordingly.

In an electronic substrate, in the case where a pixel drive chip that drives a light-emitting element to emit light is bounded on a substrate after the external production is completed, it is necessary to provide pins on the pixel drive chip to be connected with transistors on the substrate or the light-emitting element bounded on the substrate, so as to receive a data signal and output a driving current for driving the light-emitting element to emit light based on the data signal, thereby driving the light-emitting element to emit light.

Figure 1:
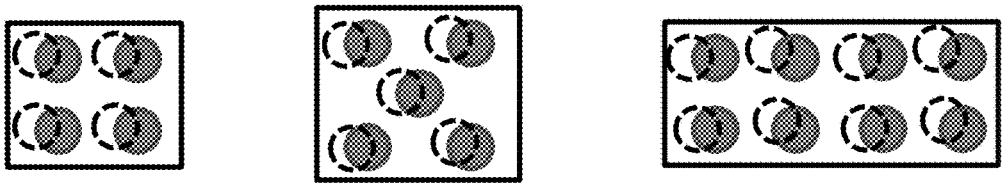
FIG. 1 is a schematic diagram showing ideal positions and actual positions of pins on pixel drive chips including different numbers of pins.

However, if the number of pins on the pixel drive chip is too large, it will affect the pixel pitch of the electronic substrate, thereby affecting the improvement of the resolution of the electronic substrate; on the other hand, if the number of pins on the pixel drive chip is too large, in the case of transferring the pixel drive chip to the electronic substrate, because the requirements for the tolerance error of each pin are very strict, it will increase the difficulty of transferring the pixel drive chip. FIG. 1 is a schematic diagram showing ideal positions and actual positions of pins on pixel drive chips including different numbers of pins.

For example, as shown in FIG. 1, a shadow indicates a position where a pin needs to be die-bonded, and a dotted line indicates an actual die-bonding position of the pin, due to certain errors in the manufacturing process, the two may not completely overlap. If the shadow and the dotted line corresponding to the shadow deviate greatly, that is, the actual die-bonding positions of some pins on the pixel drive chip deviates greatly from the ideal positions, which will cause the pixel drive chip to be unable to accept the signals transmitted on the pins and cannot output the corresponding signals to the components connected to the pins, so that, for example, the light-emitting element connected to the pixel drive chip cannot be driven to emit light normally, and the phenomenon, such as the display abnormality, occurs. For example, in the case where a pin connected to a power supply voltage line to receive a power supply voltage cannot work normally due to deviations, it will cause the pixel drive chip to fail to work, function abnormally, short-circuit, and have other phenomena because the pixel drive chip cannot accept the power supply voltage provided on the power supply voltage line; and in the case where a pin connected to an output terminal of the pixel drive chip cannot work normally due to deviations, it will cause that the pixel drive chip cannot normally output the driving current to the light-emitting element connected to the pixel drive chip, which causes the light-emitting element to not emit light, thereby causing uneven light emission of the electronic substrate.

At present, in the case where the electronic substrate transmits signals, traditional interfaces, such as I2C (Inter-Integrated Circuit, two-wire serial bus) or SPI (Serial Peripheral Interface), are usually used, such a transmission method usually requires at least two pins to provide input signals, thereby increasing the number of pins on the pixel drive chip. Therefore, how to reduce the number of pins on the pixel drive chip is a problem that needs to be solved urgently.

At least one embodiment of the present disclosure provides an electronic substrate including a pixel drive chip which includes at least one signal terminal, a signal generation circuit, a data storage circuit, and an output circuit; the at least one signal terminal is configured to be electrically connected to a light-emitting element; the signal generation circuit is connected to the at least one signal terminal, and is configured to receive an input signal through the at least one signal terminal and generate a clock signal according to the input signal; the data storage circuit is connected to the signal generation circuit and the output circuit, and is configured to receive the clock signal and store the input signal according to the clock signal; and the output circuit is configured to output a current, which is generated according to the input signal stored and used for driving the light-emitting element, through the at least one signal terminal.

Some embodiments of the present disclosure also provide a display device and a driving method corresponding to the above-mentioned electronic substrate.

The electronic substrate provided by the above-mentioned embodiments of the present disclosure can reduce the number of pins on the pixel drive chip, reduce the difficulty of transferring the pixel drive chip, avoid display problems, such as abnormal function and uneven light emission of the electronic substrate, due to the deviations of the pins, increase the pixel pitch and the display resolution of the electronic substrate, and improves the display effect of the electronic substrate.

The embodiments and examples of the present disclosure will be described in detail below with reference to the accompanying drawings.

Figure 2:
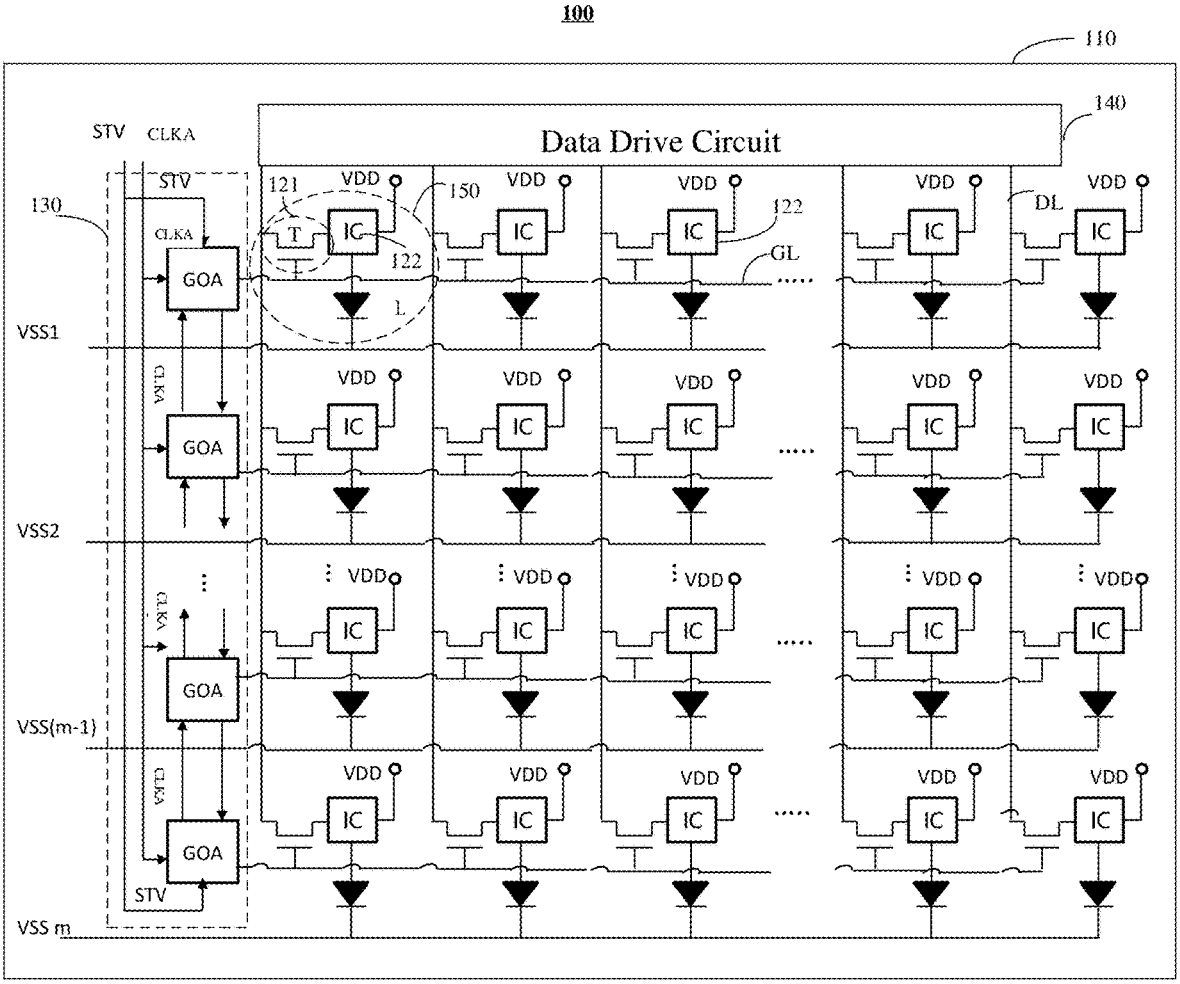
FIG. 2 is a schematic diagram of an electronic substrate provided by at least one embodiment of the present disclosure.
Figure 3A:
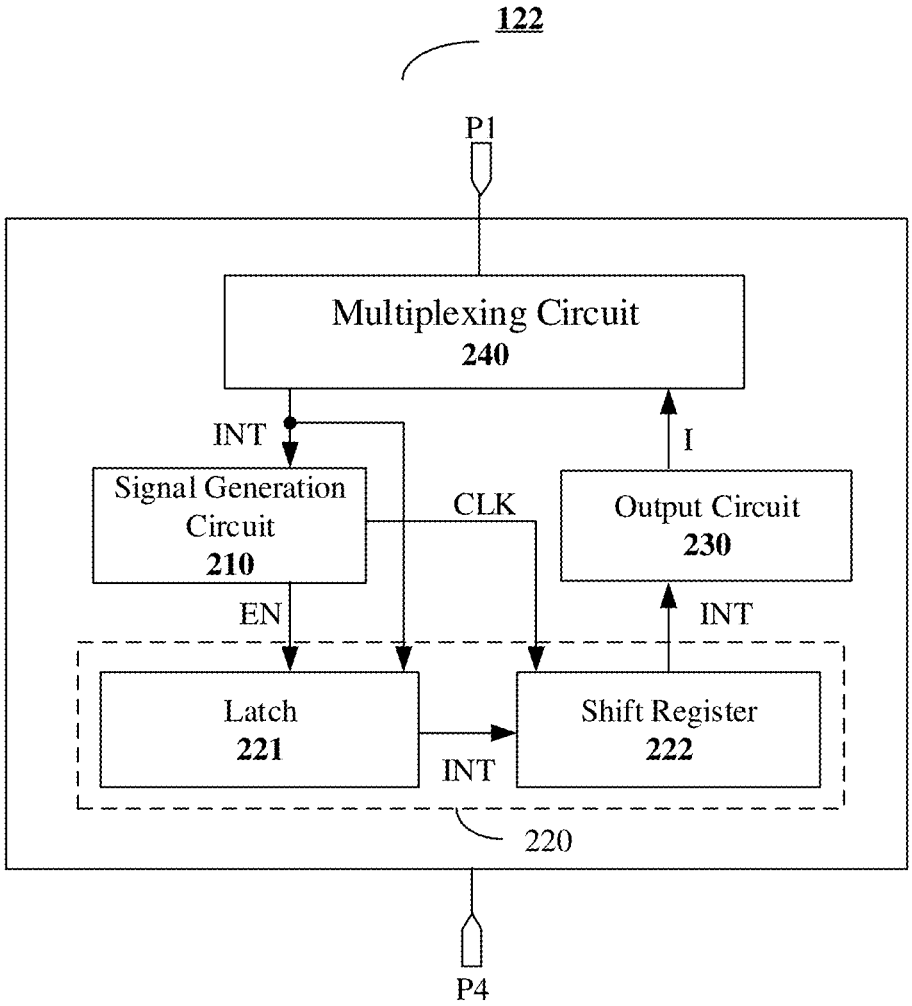
FIGS. 3A-3C are schematic diagrams of pixel drive chips including different numbers of pins provided by at least one embodiment of the present disclosure.
Figure 3B:
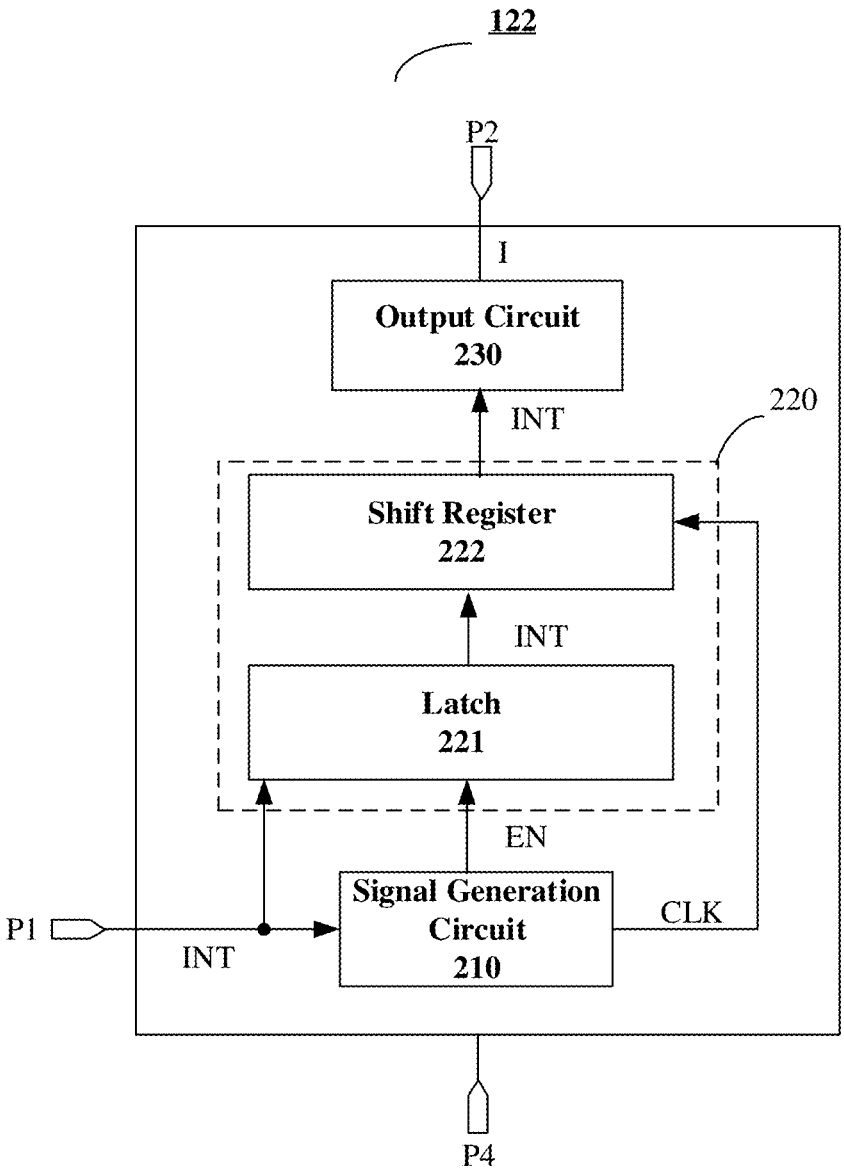
Figure 3C:
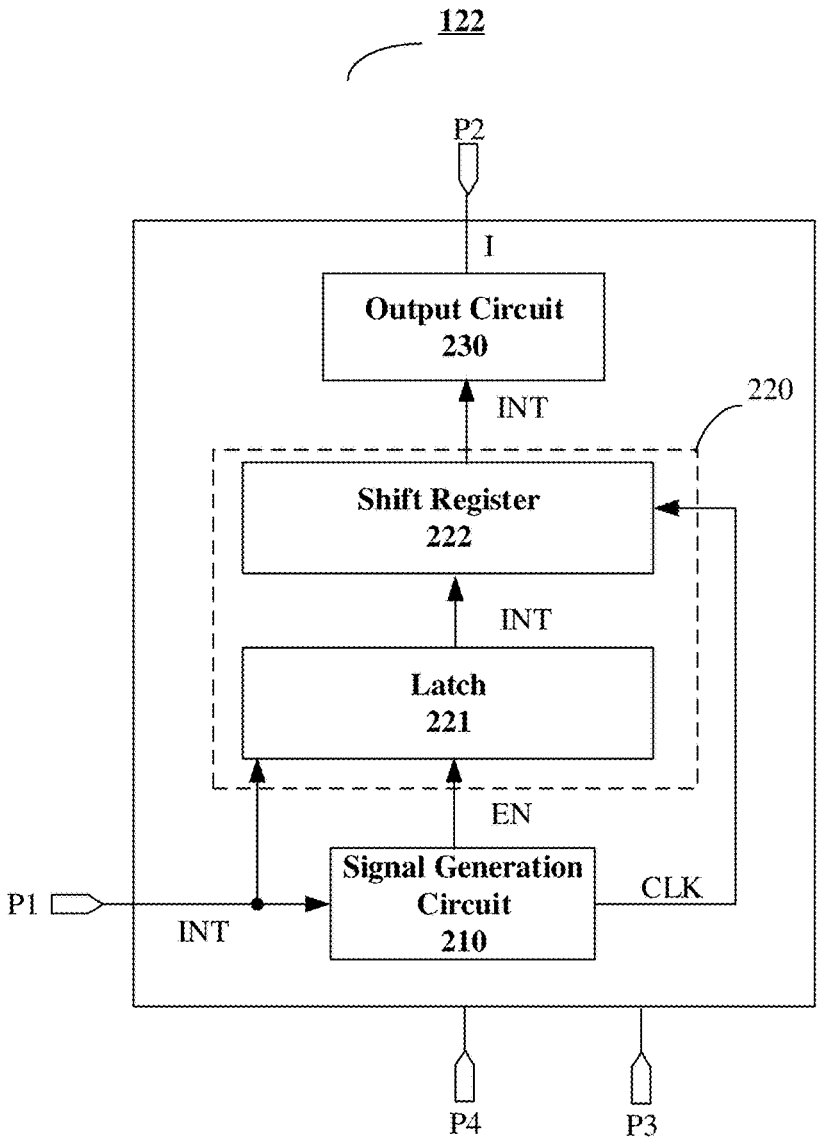

FIG. 2 is a schematic diagram of an electronic substrate provided by at least one embodiment of the present disclosure. FIGS. 3A-3C are schematic diagrams of pixel drive chips provided by at least one embodiment of the present disclosure. The electronic substrate provided by at least one embodiment of the present disclosure will be described in detail below with reference to FIG. 2, FIGS. 3A-3C, and FIGS. 4 to 12 related to the structures in FIGS. 2 to 3C.

For example, as shown in FIG. 2, in some examples, in the case where the electronic substrate 100 includes an array substrate, the array substrate includes: a base substrate (hereinafter referred to as a "substrate") 110 and a plurality of pixel units 150 arranged in an array on the substrate 110, for example, including pixel circuits arranged in m rows and q columns, m and q are both integers greater than 1. For example, each of the plurality of pixel units 150 includes a pixel drive chip 122 and at least one light-emitting element L electrically connected to the pixel drive chip 122, and the pixel drive chip is configured to output a current flowing through the light-emitting element.

For example, in other examples, for example, in the case where the electronic substrate 100 is a liquid crystal electronic substrate, the electronic substrate 100 serves as a backlight unit (not shown in the figure), and the backlight unit includes a plurality of backlight partitions (not shown in the figure). For example, the plurality of backlight partitions are driven by a local dimming method. For example, each of the plurality of backlight partitions includes a pixel drive chip, and the pixel drive chip is configured to drive the light-emitting elements in the plurality of backlight partitions to emit light.

The connection relationship and driving principle of the pixel drive chip included in the pixel unit are taken as an example for description. It should be noted that the connection relationship and driving principle of the pixel drive chips included in each backlight partition are similar to this case, and will not be repeated.

For example, FIG. 2 only schematically shows that one pixel drive chip 122 is connected to one light-emitting element L. In other examples, for example, in the example shown in FIG. 11A which will be described later, one pixel drive chip 122 is connected to Q light-emitting elements L, and Q is an integer greater than 1, for example, in some examples, Q is an integer multiple of m. The embodiments of the present disclosure are not limited to this case. For example, the at least one light-emitting element includes at least two light-emitting elements, and the at least two light-emitting elements emit light of different colors. For example, the light-emitting element can be a Mini LED or a miniature light-emitting diode, or other light-emitting diodes, and the embodiments of the present disclosure are not limited to the type of the light-emitting element.

For example, the substrate 110 is, for example, a glass substrate, a ceramic substrate, a silicon substrate, or the like. For example, in each pixel unit 150, the pixel drive chip 122 is configured to receive and store a data signal and drive at least one light-emitting element L to emit light according to the data signal. For example, the pixel drive chip may be separately manufactured and formed and then mounted on the substrate 110 through, for example, a surface mount process (SMT), and for example, the pixel drive chip may be connected to peripheral circuits (for example, a gate scan circuit and a data drive circuit), a power supply, or a light-emitting element through lead wires on pins; or the pixel drive chip may also be directly formed on the substrate 110 to achieve the corresponding function. For example, the pixel drive chip can be obtained by preparing the pixel drive chip on a silicon wafer and cutting the silicon wafer. For example, in at least one embodiment of the present disclosure, the pixel drive chip and the light-emitting element both are separately manufactured and then bounded on the substrate 110. Of course, the pixel drive chip and the light-emitting element can also be manufactured directly on the substrate 110, and the embodiments of the present disclosure are not limited thereto.

For example, as shown in FIGS. 3A-3C, in some examples, the pixel drive chip 122 includes at least one signal terminal P1 (that is, a pin), a signal generation circuit 210, a data storage circuit 220, and an output circuit 230. For example, the at least one signal terminal (for example, the signal terminal P1 as shown in FIG. 3A or the signal terminal P2 as shown in FIGS. 3B-3C) is configured to electrically connect to the light-emitting element L (shown in FIG. 2), so as to output a current for driving the light-emitting element L to emit light to the light-emitting element L through the signal terminal.

For example, the signal generation circuit 210 is connected to the at least one signal terminal, and is configured to receive the input signal INT through the at least one signal terminal and generate the clock signal CLK according to the input signal INT. For example, as shown in FIG. 3A, in the case where the at least one signal terminal includes only one signal terminal (that is, the first signal terminal P1), the pixel drive chip 122 further includes a multiplexing circuit 210, the signal generation circuit 210 can be indirectly connected to the signal terminal P1 through the multiplexing circuit 240, and after receiving the input signal INT from the signal terminal P1, the multiplexing circuit 240 transmits the input signal INT to the signal generation circuit 210; as shown in FIG. 3B or FIG. 3C, in the case where the at least one signal terminal includes a plurality of signal terminals (for example, the first signal terminal P1 and the second signal terminal P2), the signal generation circuit 210 may also be directly connected to the at least one signal terminal (for example, the first signal terminal P1), and the embodiments of the present disclosure are not limited to this case.

For example, in some examples, the input signal is a data signal, as shown in FIG. 2, the input signal is a data signal transmitted by the data drive circuit 140 through a data line DL, in the case where the switch transistor T (for example, the following takes the case that the switch transistor T is an N-type transistor as an example for illustration) is turned on in response to a scan signal provided by a gate line GL, the data signal transmitted by the data line DL is written to the signal generation circuit 210 in the pixel drive chip 122 through the signal terminal for subsequent steps.

Figure 4:
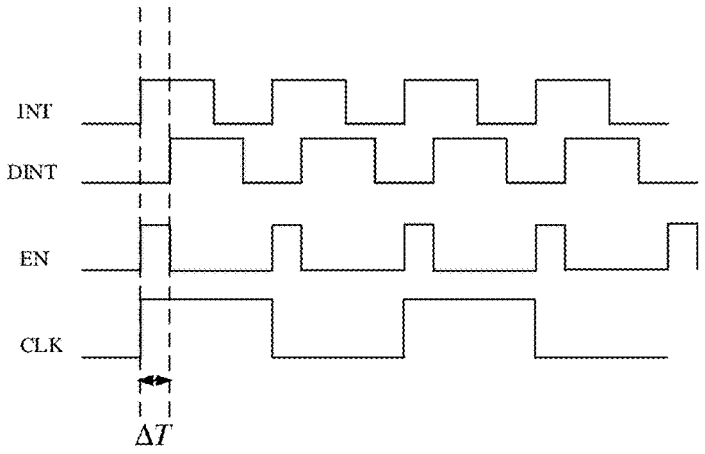
FIG. 4 is a schematic diagram of generating a clock signal provided by at least one embodiment of the present disclosure.

For example, in some examples, as shown in FIG. 4, the signal generation circuit 210 is further configured to generate a data delay signal DINT according to the input signal INT, generate a data enable signal EN according to a difference ΔT between the data delay signal DINT and the input signal INT, and generate the clock signal CLK according to the data enable signal EN. In these examples, because the duty cycles of the input signals (for example, the data signals) received by the signal generation circuit 210 may be inconsistent, the input signal INT can be obtained first, and a signal (i.e., the data enable signal EN) is generated based on the difference between the input signal INT and a delayed signal (i.e., the data delay signal DINT) of the input signal INT, because the duty cycles of the acquired data enable signals EN are consistent, the duty cycles of the clock signals CLK generated based on the data enable signals EN are also consistent, so that a relatively stable clock signal CLK can be obtained for use in the subsequent steps. Through the signal generation circuit 210, only one pin for receiving the input signal is required, and the clock signal is generated according to the received input signal, and the input signal is shifted and stored based on the clock signal, so that at least two pins in the traditional technology are not needed to achieve to receive, shift, and store the input signal, thereby reducing the number of signal terminals (i.e., pins) configured to receive and store the input signal in the electronic substrate.

For example, as shown in FIGS. 3A-3C, the data storage circuit 220 is connected to the signal generation circuit 210 and the output circuit 230, and is configured to receive the clock signal CLK and store the input signal INT according to the clock signal CLK.

For example, in some examples, as shown in FIGS. 3A-3C, the data storage circuit 220 includes a latch 221 and a shift register 222. For example, the latch 221 is connected to the signal generation circuit 210 and is configured to store the input signal INT and the data enable signal EN; and the shift register 222 is connected to the latch 221 and the output circuit 230, and is configured to shift and store the input signal INT according to the clock signal CLK.

Figure 5A:
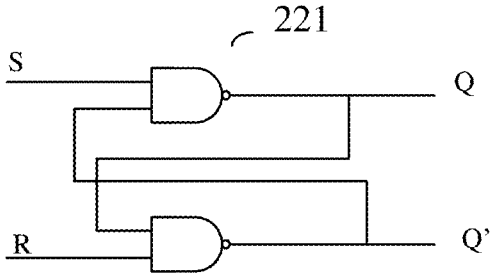
FIG. 5A is a schematic diagram of a latch provided by at least one embodiment of the present disclosure.

FIG. 5A is a schematic diagram of a latch provided by at least one embodiment of the present disclosure. For example, as shown in FIG. 5A, the latch 221 may adopt an SR latch, a set terminal S is an input terminal and receives the input signal INT output by the signal generation circuit 210, and an Q terminal is used as an output terminal. In the case where the latch 221 does not latch data, that is, in the case where the data enable signal EN is effective, that is, in the case where the level state of the set terminal S and the level state of the reset terminal R (for example, receiving the data enable signal EN generated by the signal generation circuit 210) are inconsistent, the output terminal Q changes with the change of the input signal of the set terminal S, that is, the input signal INT is output to the output terminal Q, that is, to the shift register 222 connected to the latch 221; in the case where the latch 221 acts as a latch function, that is, in the case where the data enable signal EN is non-effective, the input signal is buffered in the latch 221.

Figure 5B:
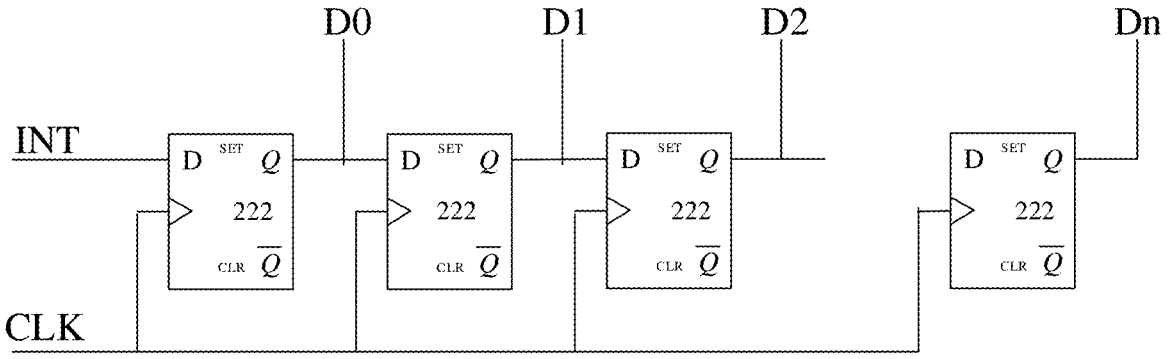
FIG. 5B is a schematic diagram of a shift register provided by at least one embodiment of the present disclosure.

FIG. 5B is a schematic diagram of a shift register provided by at least one embodiment of the present disclosure. For example, as shown in FIG. 5B, the pixel drive chip includes n (n is an integer greater than or equal to 1) shift registers to shift and store the input signal. Each shift register stores 1 bit of data, so that the number of shift registers can be determined according to the number of bits representing the gray scale (data signal). For example, if an 8-bit electronic substrate is taken as an example for description, the gray scale of each light-emitting element ranges from 0 to 255, that is, the gray scale corresponding to each light-emitting element is represented by 8 bits (i.e., 1 byte includes 8 bits). If each pixel drive chip is connected to two light-emitting elements, the input signal required by the two light-emitting elements includes 2 bytes, that is, 16 bits, that is, n=16, that is, the pixel drive chip 122 receives the input signals having 16 bits, and the 16 bits of the input signals are respectively stored in the 16 shift registers as shown in FIG. 5A, the outputs D1-D8 of the first to eighth shift registers are the input signal for controlling the first light-emitting element to emit light, if the first LED corresponds to 0 gray scale, then the first to eighth shift registers store 0, respectively, the outputs D9-D16 of the ninth to sixteenth shift registers are the input signal for controlling the second light-emitting element to emit light, if the second light-emitting element corresponds to 255 gray scale, then the ninth to sixteenth shift registers store 1, respectively, and the data stored in each shift register is determined according to the actual gray scale, and the embodiments of the present disclosure are not limited to this case. For example, each shift register shifts and stores the above-mentioned input signal in response to the rising edge of the clock signal CLK generated by the signal generation circuit 210. It should be noted that the working process and structure of the shift register can refer to the design in the art, and will not be repeated here.

It should be noted that the connection between the latch and the shift register is not limited to those as shown in FIGS. 3A-3C, it is also possible that the signal generation circuit 210 is connected to the shift register 222 first, and then the shift register is connected to the latch 221, so as to shift and store the input signal first and then input the shifted and stored input signal to the latch 221. The embodiments of the present disclosure are not limited to this case.

For example, the output circuit 230 is configured to output a current, which is generated according to the stored input signal INT and used for driving the light-emitting element, through the at least one signal terminal. For example, the output circuit 230 includes a current control circuit (not shown in the figure), and the current control circuit can call a look-up table for storing the correspondence, which is between the grayscale values of the input signal and the currents, and located outside the pixel drive chip, and therefore, in the case where the input circuit 230 receives the input signal, according to the grayscale value of the input signal, the corresponding current can be queried in the look-up table, then the transmitted current is converted into an analog signal through a digital-to-analog conversion circuit, and the current that is converted into the analog signal is output to the corresponding light-emitting element to drive the corresponding light-emitting element to emit light.

For example, in some examples, in the case where the at least one signal terminal includes only one signal terminal, that is, in the example shown in FIG. 3A, in the case where the at least one signal terminal includes only a first signal terminal P1, the pixel drive chip 122 also includes a multiplexing circuit 240. The output circuit 230 may be indirectly connected to the first signal terminal P1 through the multiplexing circuit 240, and the multiplexing circuit 240 receives the output of the output circuit 230 and transmits the output to the first signal terminal P1; as shown in FIG. 3B or FIG. 3C, in the case where the at least one signal terminal includes the first signal terminal P1 and the second signal terminal P2, the output circuit 230 may also be directly connected to the at least one signal terminal (i.e., the second signal terminal P2), the embodiments of the present disclosure are not limited to this case.

Figure 10A:
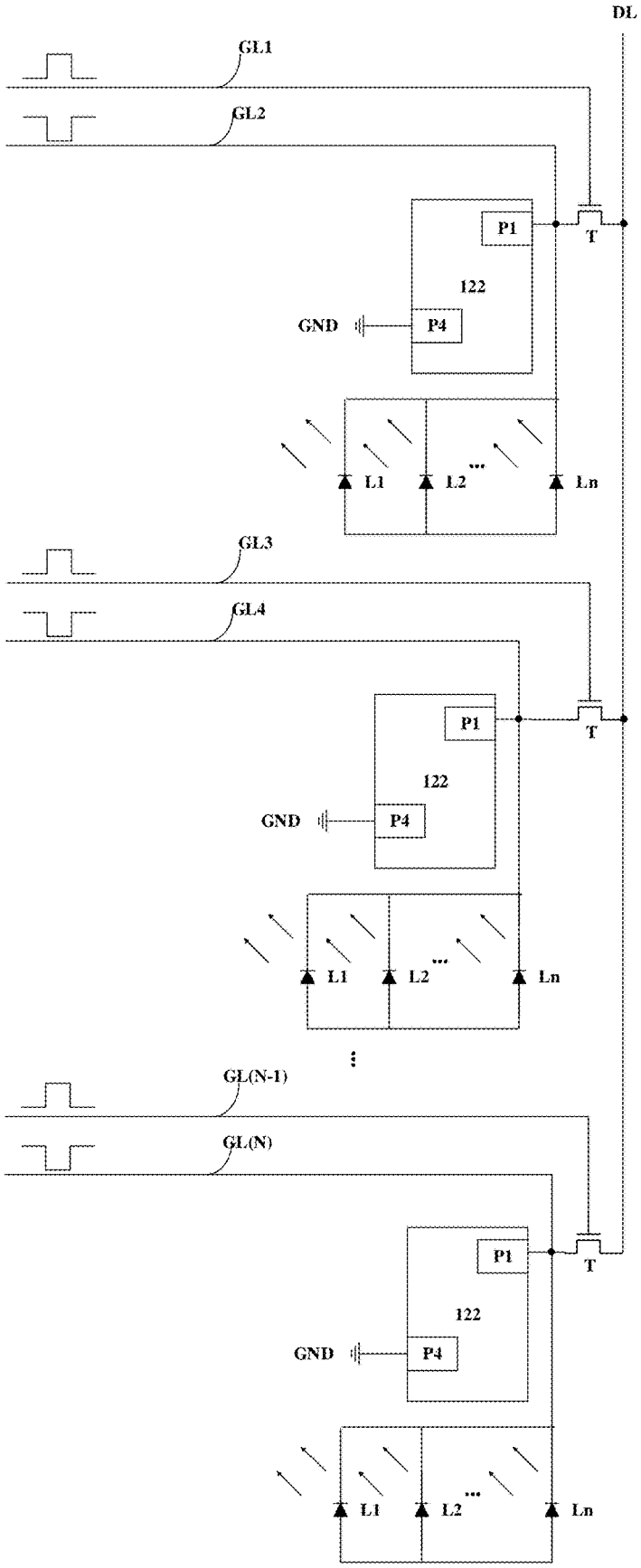
FIG. 10A is a schematic structural diagram of the pixel drive chip as shown in FIG. 3A.

In the case where the at least one signal terminal includes only the first signal terminal P1, the first signal terminal P1 is connected to the light-emitting element L (as shown in FIG. 10A), so that the current I output by the output circuit 230 can be input to the light-emitting element L.

Because in the case where the at least one signal terminal includes only the first signal terminal P1, the first signal terminal P1 is not only connected to the signal generation circuit 210 through the multiplexing circuit 240 to provide the input signal, but also is connected to the output circuit 230 through the multiplexing circuit 240 to receive the current I for driving the light-emitting element L, it is necessary to adopt the time-sharing driving technology to achieve to drive the pixel drive chip 122 through the multiplexing circuit 240, so that the input signal and the current can be transmitted through the same signal terminal (the first signal terminal P1) without mutual influence. For example, as shown in FIG. 3A, the multiplexing circuit 240 is connected to the first signal terminal P1, the signal generation circuit 210, and the output circuit 230, and is configured to: in a first period, connect the first signal terminal P1 to the signal generation circuit 210 to provide the input signal, and in a second period, connect the first signal terminal P1 to the output circuit 230 to output the current I to the light-emitting element L, so that time-sharing driving of the pixel drive chip 122 can be achieved.

Figure 12:
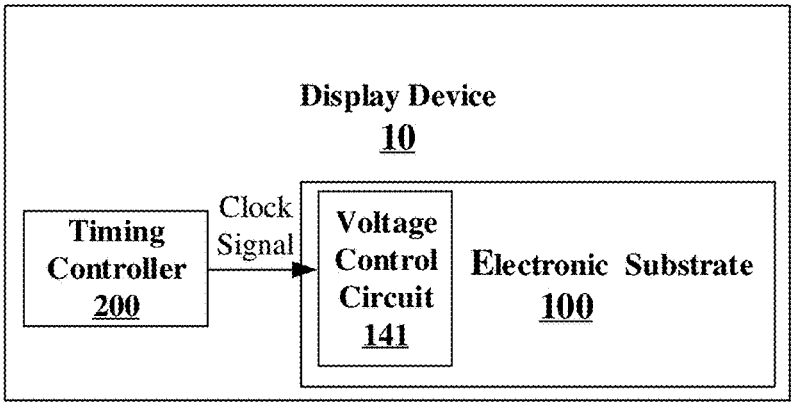
FIG. 12 is a schematic diagram of a display device provided by at least one embodiment of the present disclosure.

For example, a timing controller 200 (as shown in FIG. 12) controls the synchronization between the input signal (i.e., the data signal) and the clock signal (CLKA) that is transmitted to the gate drive circuit 130, so that in the case where the gate drive circuit 130 outputs the scan signal to the gate line GL of a corresponding row, the timing controller controls the data drive circuit 140 to apply the data signal to the data line DL of a corresponding column. Therefore, the time when the input signal is input to the first signal terminal P1 of the pixel drive chip can be controlled.

For example, the multiplexing circuit 240 may determine the signal received by the multiplexing circuit 24 to determine whether the period belongs to the first period or the second period. For example, in the case where the signal received by the multiplexing circuit 240 is a pulse signal, it is determined that the period belongs to the first period, so that, in this period, the first signal terminal P1 is connected to the signal generation circuit 210 to provide the input signal; in the case where the signal received by the multiplexing circuit 240 is a DC signal, it is determined that the period belongs to the second period, therefore, in this period, the first signal terminal P1 is connected to the output circuit 230 to output the current I to the light-emitting element L, so that the time-sharing driving of the pixel drive chip 122 can be achieved.

For example, a specific process of the time-sharing driving can be described with reference to FIG. 10B below, and will not be repeated here.

Figure 6:
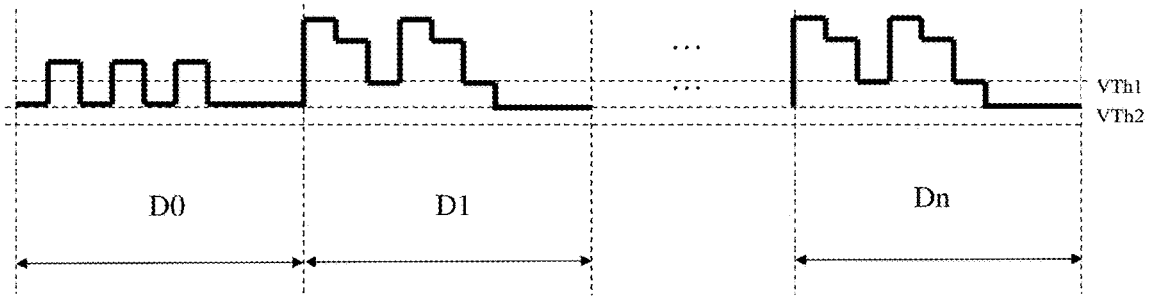
FIG. 6 is a schematic diagram of a waveform of an input signal provided by at least one embodiment of the present disclosure.

For example, in the example as shown in FIG. 3B, the pixel drive chip 122 comprises a first signal terminal P1, a second signal terminal P2, and a fourth signal terminal P4. FIG. 6 is a schematic diagram of a waveform of an input signal provided by at least one embodiment of the present disclosure. As shown in FIG. 6, in this example, the input signal comprises, for example, n data signals D1-Dn. For example, all levels of the input signal (that is, the n data signals D1-Dn included) are higher than a bias voltage VTh1 of the data signal and a bias voltage VTh2 of the first power supply voltage. For example, in this example, the input signal can not only be used as the data signal to generate the current to drive the light-emitting element, but also can be used as the first power supply voltage (for example, a high voltage) required by the pixel drive chip to drive the pixel drive chip to normally operate.

For example, it is possible to add the bias voltage VTh1 of the data signal and the bias voltage VTh2 of the first power supply voltage to the input signal, so that the input signal is transmitted based on the bias voltage as a voltage basis level (or reference voltage), thereby ensuring that all levels of the input signal are higher than the bias voltage VTh1 of the data signal and the bias voltage VTh2 of the first power supply voltage. By setting the input signal to be higher than the bias voltage VTh1 of the data signal, it can be ensured that the input signal can be used as the data signal to generate the current for driving the light-emitting element, in addition, by setting the input signal to be higher than the bias voltage VTh2 of the first power supply voltage, it can be ensured that the input signal can satisfy the condition in which the input signal is used as the first power supply voltage to drive the pixel drive chip to work, and therefore, through this setting mode, the pixel drive chip can operate normally without including a pin (for example, the third signal terminal P3 shown in FIG. 3C) for separately supplying the power supply voltage. Thus, in this example, the third signal terminal P3 that provides the first power supply voltage separately on the pixel drive chip can also be reduced, so that the pixel drive chip 122 only includes three signal terminals: the first signal terminal P1, the second signal terminal P2, and the fourth signal terminal P4, and can also operate normally.

For example, all levels of the data enable signal EN and the clock signal CLK may also be higher than the bias voltage VTh1 of the data signal and the bias voltage VTh2 of the first power supply voltage, the embodiments of the present disclosure are not limited to this case.

Figure 7:
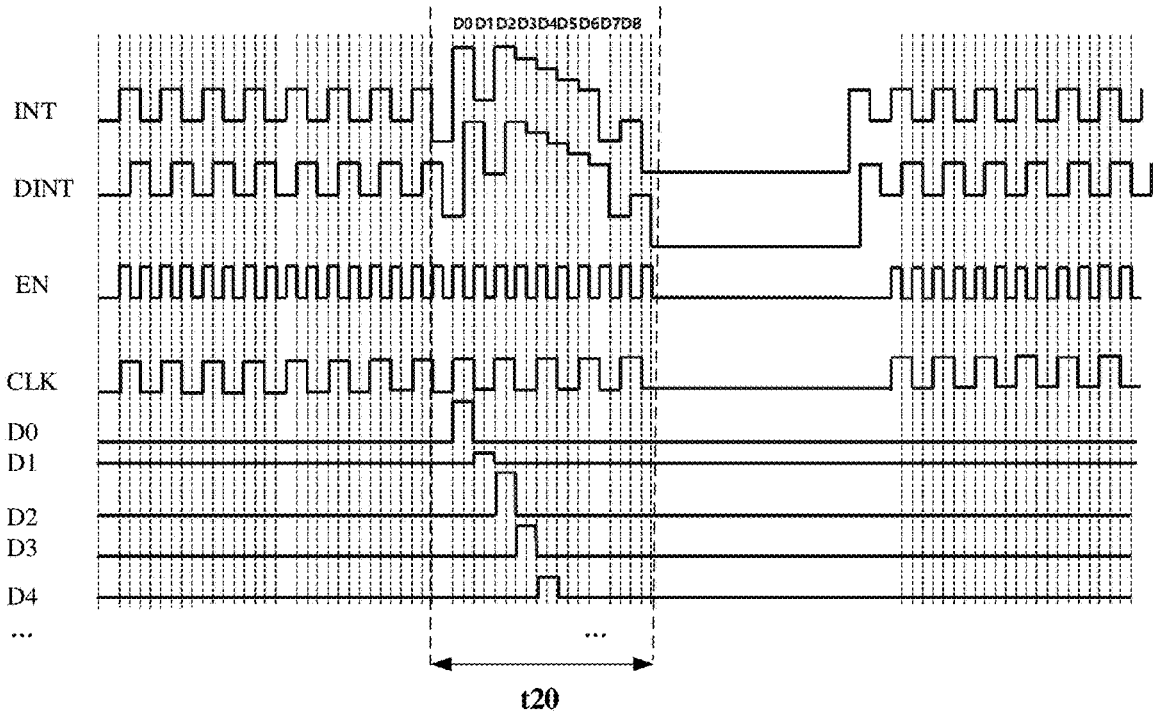
FIG. 7 is a schematic diagram of a timing sequence for shifting and storing an input signal provided by at least one embodiment of the present disclosure.

FIG. 7 is a schematic diagram showing a timing sequence for shifting and storing an input signal in a systematic manner in combination with FIG. 4 and FIG. 6 provided by at least one embodiment of the present disclosure.

For example, as shown in FIG. 7, at a phase t20, the data processing shown in FIG. 6 are performed on, for example, the data signals D0-D8 (for example, FIG. 7 only shows a schematic diagram when n=8, and the embodiments of the present disclosure are not limited to this case) included in the input signal INT, that is, the data signals D0-D8 are transmitted based on the bias voltage VTh1 of the input signal and the bias voltage VTh2 of the first power supply voltage as the voltage levels (or reference voltages), the clock signal CLK is obtained based on the enable signal EN generated according to the input signal INT, on which the data processing is performed, and the data delay signal DINT, and the input signal is shifted and sequentially stored in respective shift registers based on the clock signal CLK to obtain D0, D1, . . . Dn, respectively.

Figure 9A:
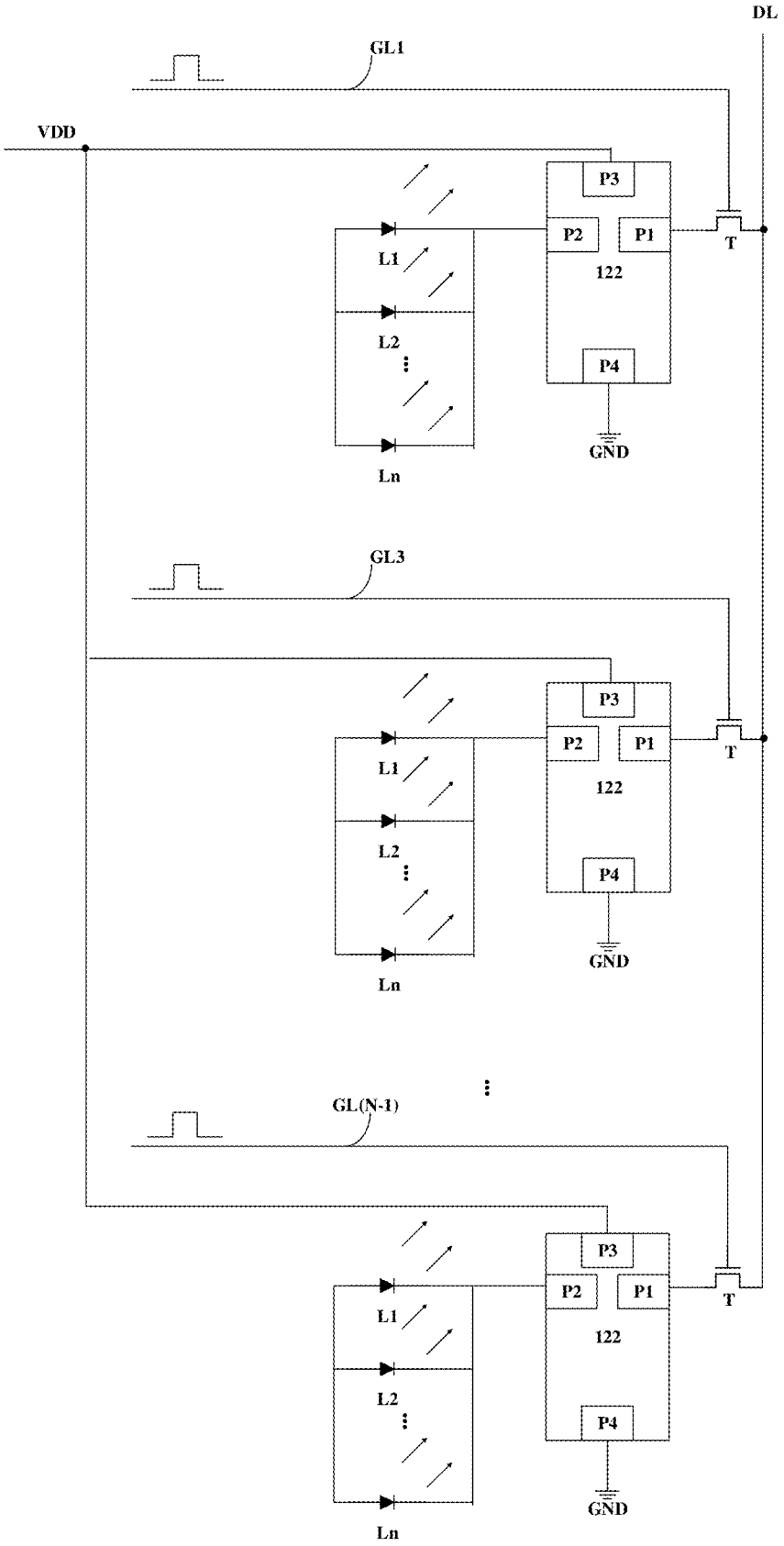
FIG. 9A is a schematic structural diagram of the pixel drive chip as shown in FIG. 3C.

In some other examples of the present disclosure, for example, as shown in FIGS. 3C and 9A, on the basis of the example shown in FIG. 3B, the pixel drive chip 122 further includes a third signal terminal P3, and the third signal terminal P3 is configured to provide a first power supply voltage to the pixel drive chip 122. For example, the first power supply voltage includes the bias voltage VTh2, that is, the first power supply voltage is greater than the bias voltage VTh2, so as to satisfy the condition for driving the pixel drive signal to operate. For specific introduction, please refer to the introduction of FIG. 9A below, which will not be repeated here.

In this example, because the first power supply voltage is provided by a separate third signal terminal P3, the input signal does not need to be transmitted based on the bias voltage VTh2 of the first power supply voltage as the voltage level (or reference voltage), so that the digital processing and the simulation can be performed separately, which is beneficial to simplify the design of the pixel drive chip, thereby enabling the structure of the pixel drive chip simple, reducing the area of the pixel drive chip, and improving the resolution of the electronic substrate.

In other examples of the present disclosure, for example, as shown in FIGS. 3A to 3C, the pixel drive chip further includes a fourth signal terminal P4, the fourth signal terminal P4 is configured to provide a second power supply voltage (less than the first power supply voltage, for example, a ground voltage) to the pixel drive chip 122, and the second power supply voltage is opposite to the first power supply voltage and is used for driving the pixel drive chip to operate normally.

In some embodiments of the present disclosure, for example, in the electronic substrate provided by the foregoing embodiments of the present disclosure, the number of signal terminals (i.e. pins) connected to the signal generation circuit 210 includes only one (for example, the first signal terminal P1) or more than one, and therefore, compared with the traditional design that needs to include two pins for providing input signals, the electronic substrate provided by the above-mentioned embodiments of the present disclosure can reduce the number of pins of the pixel drive chip; in addition, in other embodiments of the present disclosure, the signal generation circuit 210 and the output circuit 230 may share one pin (the first signal terminal P1 shown in FIG. 2), so that the number of pins of the pixel drive chip can be further reduced, and thus, the difficulty of transferring the pixel drive chip can be reduced, and display problems, such as abnormal functions of the electronic substrate and uneven light emission caused by pin deviation, can be avoided, the pixel pitch and the display resolution of the electronic substrate can be improved, and the display effect of the electronic substrate can be improved.

Figure 8A:
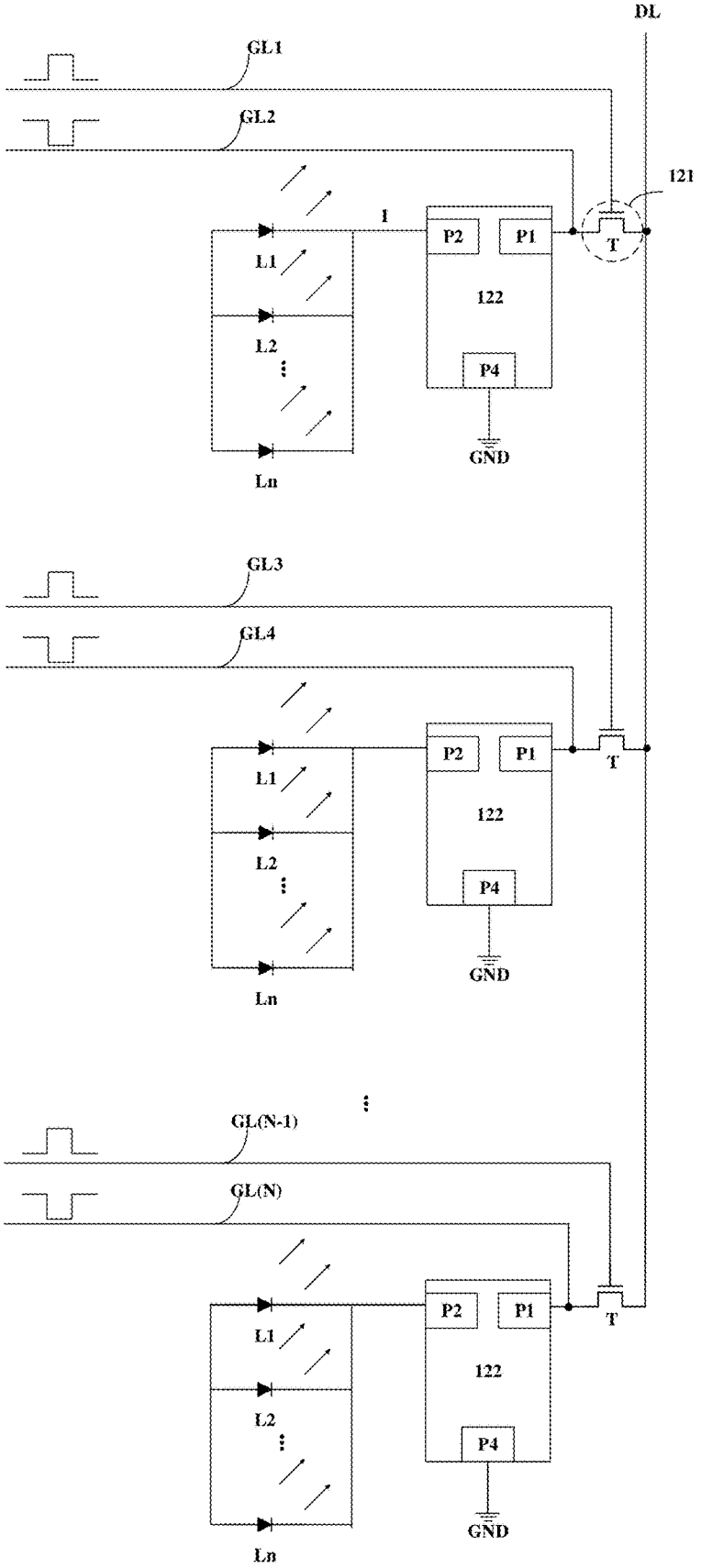
FIG. 8A is a schematic structural diagram of the pixel drive chip as shown in FIG. 3B.
Figure 8B:
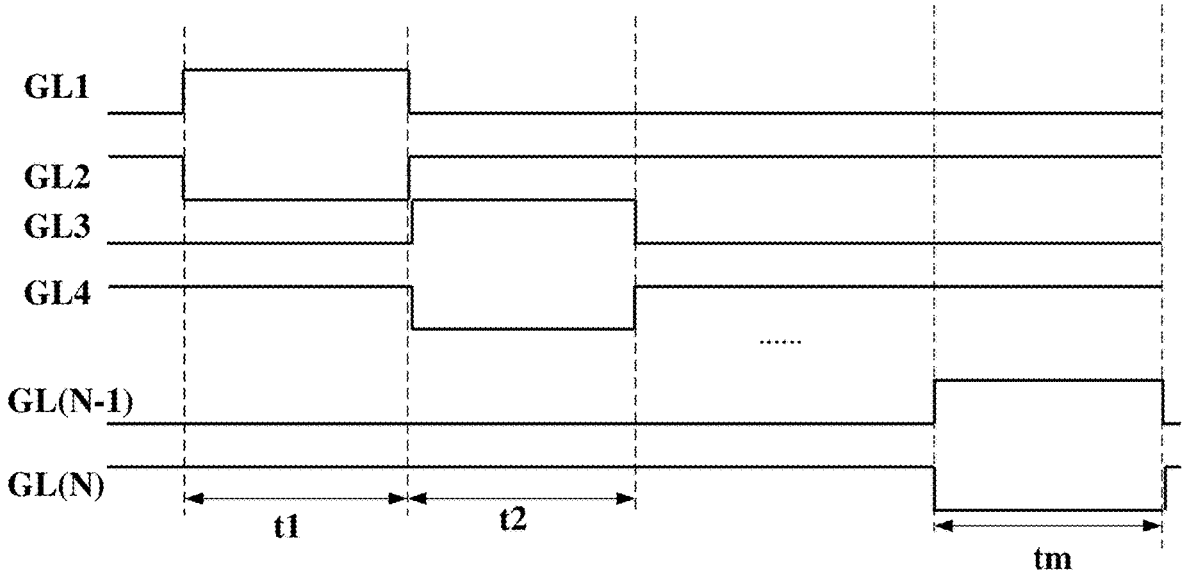
FIG. 8B is a signal timing diagram of the pixel drive chip as shown in FIG. 8A.

FIG. 8A is a schematic structural diagram of the pixel drive chip as shown in FIG. 3B. FIG. 8B is a signal timing diagram of the pixel drive chip as shown in FIG. 8A. Hereinafter, the working principle of the pixel drive chip shown in FIG. 3B will be described in detail with reference to FIGS. 8A and 8B.

For example, in the examples shown in FIGS. 3B and 8A, the pixel drive chip includes three signal terminals P1, P2, and P3. For example, in this example, at least one signal terminal includes a first signal terminal P1 and a second signal terminal P2. For example, the first signal terminal P1 is connected to the signal generation circuit 210 to provide an input signal to the signal generation circuit 210, and the second signal terminal P2 is connected to the output circuit 230 and the light-emitting elements L1-Ln to output the current I output by the output circuit 230 to the light-emitting elements L1-Ln.

As shown in FIGS. 8A and 2, the electronic substrate 100 further includes a first switch control line GL1/GL3/ . . . GL(N−1), a data line DL, and a switch control circuit 121. For example, the switch control circuit 121 is connected to the first switch control line GL1/GL3/ . . . GL(N−1), the data line DL, and the first signal terminal P1, and is configured to transmit the input signal INT provided by the data line DL to the first signal terminal P1 in response to the first switch control signal provided by the first switch control line GL1/GL3/ . . . GL(N−1). For example, in the embodiments of the present disclosure, the first switch control line GL1/GL3/ . . . GL(N−1) is a gate line, and the first switch control signal is a scan signal output by the gate drive circuit (which will be described in detail below). N is an integer greater than or equal to 3 and less than or equal to m+1.

For example, as shown in FIGS. 8A and 2, the switch control circuit 121 includes a switch transistor T. For example, a gate electrode of the switch transistor T is connected to the first switch control line GL1/GL3/ . . . GL(N−1) to receive the first switch control signal, a first electrode of the switch transistor T is connected to the data line DL to receive the input signal, and a second electrode of the switch transistor T is connected to the first signal terminal P1. For example, the switch transistor T is turned on under the control of the first switch control signal (the scan signal), thereby connecting the first signal terminal P1 and the data line DL to input the input signal provided by the data line DL to the first signal terminal. For example, the input signal is the input signal as shown in FIG. 6, and levels of the input signal are all higher than the bias voltage VTh1 of the data signal and the bias voltage VTh2 of the first power supply voltage, so that the input signal can be used as a data signal to drive the light-emitting element to emit light, and at the same time, the pixel drive chip is also provided with the first power supply voltage (for example, high voltage) required for its operation.

As shown in FIG. 8A, in this example, the electronic substrate 100 further includes a second switch control line GL2/GL4 . . . GL(N), the second switch control line GL2/GL4 . . . GL(N) is connected to the first signal terminal P1 and the switch control circuit 121 to provide a second switch control signal opposite to the first switch control signal to the first signal terminal P1 as the first power supply voltage in the case where the switch control circuit 121 is turned off. For example, the second switch control line is connected to a pin provided on the electronic substrate 100 (for example, the pin is provided in a bonding region of the electronic substrate) to receive the second control signal as the second power supply voltage. For example, the second switch control line is connected to the timing controller 200 (for example, arranged on other chips bound on the electronic substrate) through the pins arranged in the bonding region of the electronic substrate 100 to receive the second power supply voltage.

For example, in the case where the first switch control circuit 121 is turned off, because the pixel drive chip cannot be connected to the data line, the data line cannot provide the pixel drive chip with the input signal as the first power supply voltage to drive the pixel drive chip to operate. In this case, the second switch control signal opposite to the first switch control signal is provided through the second switch control line and is used as the first power supply voltage, and is input to the pixel drive chip 122 through the first signal terminal P1, thereby ensuring that the pixel drive chip operates normally in the subsequent process.

For example, the electronic substrate 100 further includes a voltage control circuit (not shown in the figure), which is configured to provide a corresponding second switch control signal to the second switch control line according to the timing sequence of the first switch control signal provided by the first switch control line. For example, the timing sequence of the clock signal is provided by a peripheral circuit, such as the timing controller (not shown in the figure). For example, the timing controller is configured to provide a clock signal to the voltage control circuit in the electronic substrate, so that the voltage control circuit controls the timing sequence for sending the second switch signals to respective second switch control lines according to the clock signal, thereby achieving the display of the electronic substrate.

It should be noted that FIG. 8A only takes one column of pixel units connected to one data line DL in FIG. 2 as an example for description. It should be noted that the following embodiments are the same as those described herein, and similar portions will not be repeated.

As shown in FIG. 8B, in a first phase t1, a first switch control line GL1 in a first row (i.e., the gate line in the first row) provides a high level, and a second switch control line GL2 is suspended (for example, the second switch control line GL2 is disconnected from the voltage control circuit that provides the second power supply voltage to avoid affecting the transmission of the input signal) or is connected to a large resistor, so that a switch transistor T in the first row is turned on, and the input signal is written into the pixel drive chip in the first row for shifting and storing; in the other phases t2-tn after the end of the first phase t1, the first switch control line GL1 in the first row (that is, the gate line in the first row) provides a low level, so that the switch transistor T is turned off. In this case, the second switch control line GL2 provides a high level to the pixel drive chip in the first row to provide the first power supply voltage to the pixel drive chip in the first row, so as to ensure that in the subsequent phases, the pixel drive chip applies the current generated according to the data signal stored in the shift register to the first electrode of the light-emitting element, in the case where second electrodes of respective light-emitting elements L1-Ln sequentially receive a second voltage, the respective light-emitting elements L1-Ln connected to the pixel drive chip are driven to sequentially emit light of corresponding gray scales. For the specific driving method of the light-emitting element, reference may be made to the related descriptions of FIG. 11A and FIG. 11B, which will not be repeated here. The following embodiments are the same as those described herein, and similar portions will not be repeated.

In a second phase t2, a first switch control line GL3 in a second row (that is, the gate line in the second row) provides a high level, and a second switch control line GL4 is suspended or connected to a large resistor, so that a switch transistor T in the second row is turned on, thereby writing the input signal into the pixel drive chip in the second row for shifting and storing; in other phases after the end of the second phase t2, the first switch control line GL3 in the second row (that is, the gate line in the second row) provides a low level, so that the switch transistor T is turned off, in this phase, the second switch control line GL4 provides a high level to the pixel drive chip in the second row to provide the first power supply voltage to the pixel drive chip in the second row.

In a m-th phase tm, a first switch control line GL(N−1) of a m-th row (that is, the gate line of the m-th row) provides a high level, and a second switch control line GL(N) is suspended or connected to a large resistor, so that a switch transistor T in the m-th row is turned on, thereby writing the input signal into the pixel drive chip in the m-th row for shifting and storing; in other phases after the end of the m-th phase tm, the first switch control line GL(N−1) in the m-th row (that is, the gate line in the m-th row) provides a low level, so that the switch transistor T is turned off, in this phase, the second switch control line GL(N) provides a high level to the pixel drive chip in the m-th row to provide the first power supply voltage to the pixel drive chip in the m-th row.

Figure 9B:
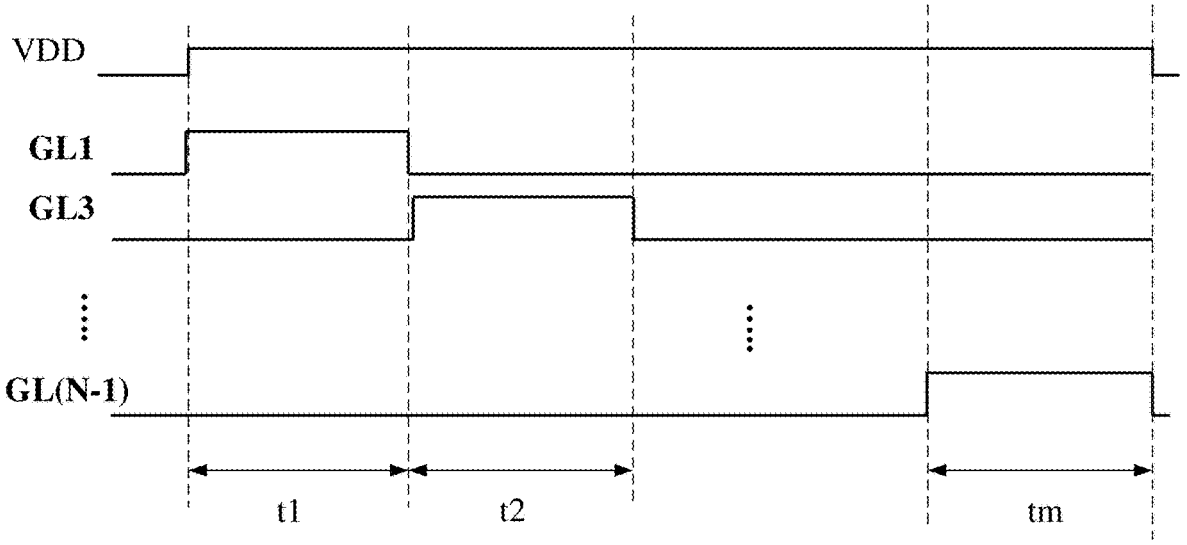
FIG. 9B is a signal timing diagram of the pixel drive chip as shown in FIG. 9A.

FIG. 9A is a schematic structural diagram of the pixel drive chip shown in FIG. 3C. FIG. 9B is a signal timing diagram of the pixel drive chip shown in FIG. 9A. Hereinafter, the working principle of the pixel drive chip shown in FIG. 3C will be described in detail with reference to FIGS. 9A and 9B.

For example, in the examples as shown in FIGS. 3C and 9A, the pixel drive chip includes four signal terminals P1, P2, P3, and P4. For example, the pixel drive chip as shown in FIG. 9A is similar to the pixel drive chip as shown in FIG. 8A, except that: the pixel drive chip 122 as shown in FIG. 9A further includes a third signal terminal P3, and the third signal terminal P3 is configured to provide a first power supply voltage to the pixel drive chip 122, and therefore, the pixel drive chip as shown in FIG. 9A may not include the second switch control line that provides the second switch control signal as the first power supply voltage.

In this example, because the first power supply voltage is provided by a separate third signal terminal P3, the input signal does not need to be transmitted based on the bias voltage VTh2 of the first power supply voltage as the voltage level (or the reference voltage), and the circuit for controlling the second switch control signal can also be reduced, so that the digital processing and the simulation can be performed separately, which is beneficial to simplify the design of the pixel drive chip, thereby enabling the structure of the pixel drive chip simple, reducing the area of the pixel drive chip, and improving the resolution of the electronic substrate.

For example, the third signal terminals P3 of the respective pixel drive chips can be connected together to receive the first power supply voltage for driving the pixel drive chips to operate normally.

The phases in the timing diagram shown in FIG. 9B are similar to the phases in the timing diagram shown in FIG. 8B, and the differences therebetween are that: the first power supply voltage received by the third signal terminal P3 is at a high level in all phases, and there is no second switch control signal provided by the second switch control signal line GL2/GL4 . . . GL(N). For the specific process of this example, reference may be made to the description of FIG. 8B, which will not be repeated here.

FIG. 10A is a schematic structural diagram of the pixel drive chip shown in FIG. 3A. FIG. 10B is a signal timing diagram of the pixel drive chip shown in FIG. 10A. Hereinafter, the working principle of the pixel drive chip shown in FIG. 3A will be described in detail with reference to FIGS. 10A and 10B.

For example, in the example as shown in FIGS. 3A and 10A, the pixel drive chip includes two signal terminals P1 and P4. For example, the pixel drive chip as shown in FIG. 10A is similar to the pixel drive chip as shown in FIG. 8A, except that: at least one signal terminal of the pixel drive chip 122 as shown in FIG. 10A only includes the first signal terminal P1.

For example, as shown in FIG. 10A, the first signal terminal P1 is connected to the light-emitting elements L1-Ln, so that the current I output by the output circuit 230 can be input to the light-emitting elements L1-Ln.

Because in the case where the at least one signal terminal included in the pixel drive chip includes only the first signal terminal P1, the first signal terminal P1 is connected to the signal generation circuit 210 through the multiplexing circuit 240 to provide an input signal, and is also connected to the output circuit 230 through the multiplexing circuit 240 to receive the current I for driving the light-emitting elements L1-Ln, the pixel drive chip 122 needs to be time-divisionally driven by the multiplexing circuit 240 to achieve that the input signal and the current are transmitted through the same signal terminal (the first signal terminal P1) without affecting each other. For example, as shown in FIG. 3A, the multiplexing circuit 240 is connected to the first signal terminal P1, the signal generation circuit 210, and the output circuit 230, and is configured to: in the first period, connect the first signal terminal P1 to the signal generation circuit 210 to provide an input signal, and in the second period, connect the first signal terminal P1 to the output circuit 230 to output the current I to the light-emitting element L, thereby achieving the time-sharing driving of the pixel drive chip 122.

Figure 10B:
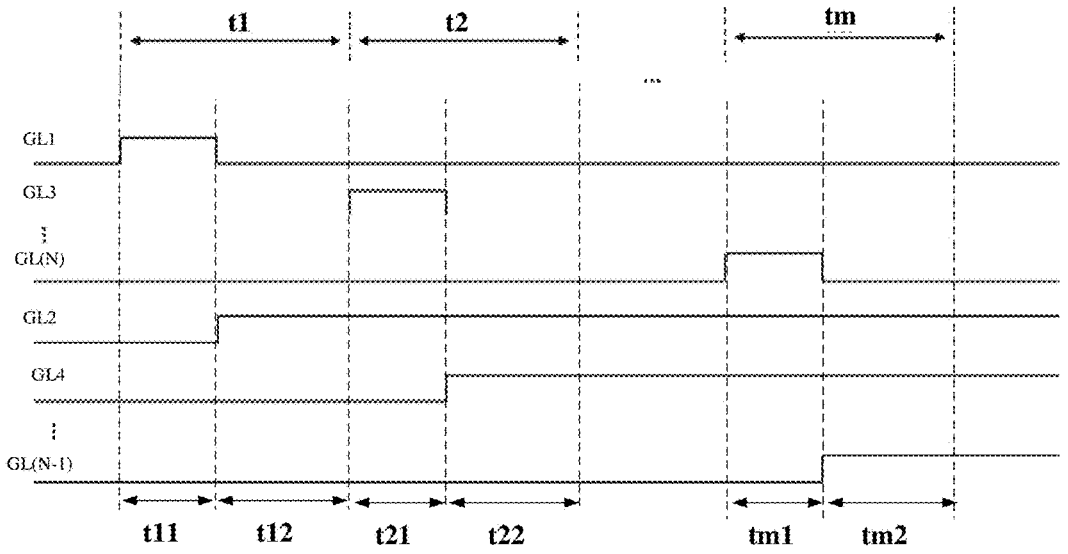
FIG. 10B is a signal timing diagram of the pixel drive chip as shown in FIG. 10A.

FIG. 10B is a schematic timing diagram of time-sharing driving of the pixel drive chip.

As shown in FIG. 10B, in a first sub-phase t11 of the first phase t1, the first switch control line GL1 in the first row (that is, the gate line in the first row) provides a high level, the second switch control line GL2 is suspended or connected to a large resistor, so that the switch transistor T in the first row is turned on, and the input signal is written into the first signal terminal P1 of the pixel drive chip 122 in the first row. For example, in this phase, the multiplexing circuit 240 connects the first signal terminal P1 with the signal generation circuit 210 to receive the input signal received by the first signal terminal P1 for shifting and storing.

In a second sub-phase t12 of the first phase t1 and the other phases t2-tn after the end of the first sub-phase t11, the first switch control line GL1 in the first row (that is, the gate line in the first row) provides a low level, so that the switch transistor T is turned off, in this case, the second switch control line GL2 provides a high level to the pixel drive chip in the first row to provide the first power supply voltage to the pixel drive chip in the first row, so as to ensure that in this phase, the pixel drive chip can apply the current generated according to the data signal stored in the shift register to the first electrode of the light-emitting element, in the case where second electrodes of respective light-emitting elements L1-Ln sequentially receive the second voltage, the respective light-emitting elements L1-Ln connected to the pixel drive chip are driven to sequentially emit light of corresponding gray scales. For example, in this phase, the first signal terminal P1 is connected to the output circuit 230 to output the current I to the light-emitting element L, so that time-sharing driving of the pixel drive chip 122 can be achieved. For the specific driving method of the light-emitting element, reference may be made to the related descriptions of FIG. 11A and FIG. 11B, which will not be repeated here. The following embodiments are the same as those described herein, and similar portions will not be repeated.

In a first sub-phase t21 of the second phase t2, the first switch control line GL3 in the second row (that is, the gate line in the second row) provides a high level, and the second switch control line GL4 is suspended or connected to a large resistor, so that the switch transistor T in the second row is turned on, and the input signal is written into the pixel drive chip in the second row for shifting and storing.

In a second sub-phase t22 of the second phase t2 and other phases after the end of the first sub-phase t21, the first switch control line GL3 in the second row (that is, the gate line in the third row) provides a low level, so that the switch transistor T is turned off, in this phase, the second switch control line GL4 provides a high level to the pixel drive chip in the second row to provide the first power supply voltage to the pixel drive chip in the second row.

In a first sub-phase tm1 of the m-th phase tm, a first switch control line GL(N−1) of a m-th row (that is, the gate line of the m-th row) provides a high level, and a second switch control line GL(N) is suspended or connected to a large resistor, so that a switch transistor T in the m-th row is turned on, thereby writing the input signal into the pixel drive chip in the m-th row for shifting and storing; in a second sub-phase tm2 of the m-th phase tm and other phases after the end of the first sub-phase tm1, the first switch control line GL(N−1) in the m-th row (that is, the gate line in the m-th row) provides a low level, so that the switch transistor T is turned off, in this phase, the second switch control line GL(N) provides a high level to the pixel drive chip in the m-th row to provide the first power supply voltage to the pixel drive chip in the m-th row.

The input signal is received in the first sub-phase of each phase to achieve shifting and storing of the input signal, and the first power supply voltage is received in the second sub-phase to output the current generated based on the input signal to the first electrode of the light-emitting element through the output circuit 230 to drive the light-emitting element to emit light, so that the time-sharing driving of the pixel drive chip can be achieved.

For example, each of the at least one light-emitting element L includes a first electrode and a second electrode. For example, FIGS. 8A-10A are described by taking the case that the cathodes of the light-emitting elements L in each row are connected to the signal terminal of the pixel drive chip as an example. In this case, the first electrode of the light-emitting element L is a cathode, and the second electrode of the light-emitting element L is an anode. It should be noted that, in some examples, the light-emitting elements L in each row can also be connected to the signal terminal of the pixel drive chip by using the anodes of the light-emitting elements L in each row, in this case, the first electrode of the light-emitting element L is the anode and the second electrode of the light-emitting element L is the cathode. The details may be determined according to actual conditions, and the embodiments of the present disclosure are not limited to this case.

Figure 11A:
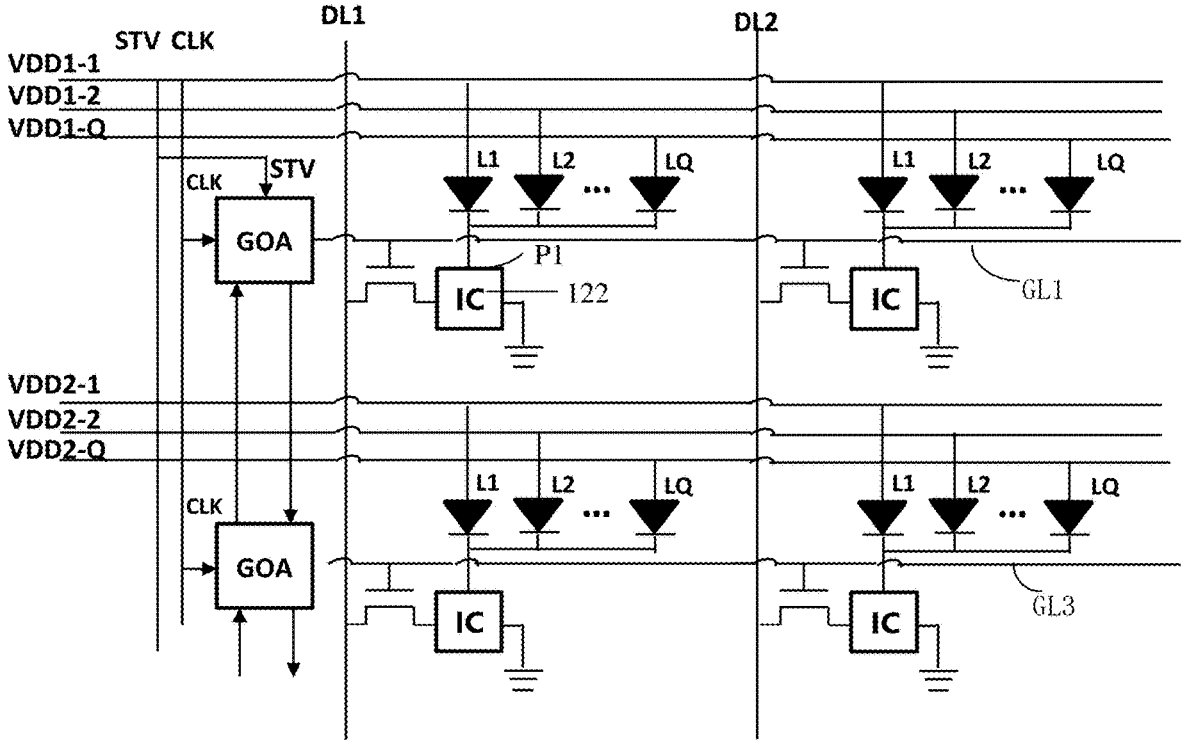
FIG. 11A is a schematic diagram showing an example of a connection of the light-emitting elements as shown in FIG. 8A, FIG. 9A, and FIG. 10A.
Figure 11B:
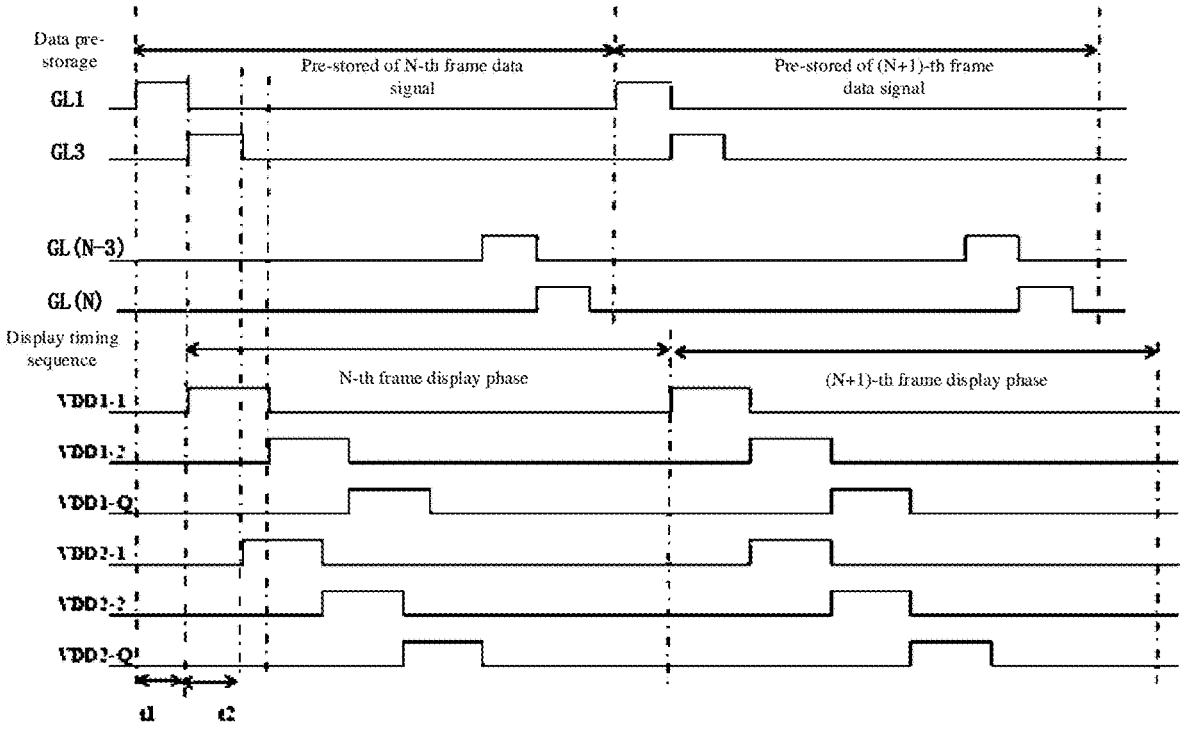
FIG. 11B is a schematic diagram of a driving timing sequence of the light-emitting elements as shown in FIG. 11A.

FIG. 11A is a schematic diagram showing an example of a connection of the light-emitting elements L1-LQ (Q is greater than or equal to 2 and less than or equal to n) as shown in FIG. 8A, FIG. 9A, and FIG. 10A. FIG. 11B is a schematic diagram of a driving timing sequence of the light-emitting elements as shown in FIG. 11A. The electronic substrate provided by at least one embodiment of the present disclosure will be described in detail below with reference to FIGS. 11A and 11B.

For example, in the example shown in FIG. 11A, at least one light-emitting element includes a plurality of light-emitting elements, for example, includes Q light-emitting elements L1-LQ, and the pixel drive chip 122 includes one first signal terminal P1 to be connected to the Q light-emitting elements L1-LQ.

For example, as shown in FIG. 11A, the electronic substrate 100 further includes a plurality of groups of second voltage lines, and the plurality of groups of second voltage lines are connected to a plurality of rows of pixel circuits in a one-to-one correspondence manner. For example, FIG. 11A only schematically illustrates pixel circuits arranged in 2 rows and 2 columns. The electronic substrate includes two groups of second voltage lines VDD1-1 to VDD1-Q and VDD2-1 to VDD2-Q, which are connected correspondingly to the two rows of pixel circuits as shown in FIG. 11A. Of course, the specific settings can be determined according to actual conditions, and the embodiments of the present disclosure are not limited to this case. For example, as shown in FIG. 11A, there are also a first data line DL1 and a second data line DL2 connected to the pixel circuits arranged in 2 rows and 2 columns, the first data line DL1 and the second data line DL2 are connected to the data drive circuit, and are respectively configured to provide data signals to respective columns of pixel circuits connected thereto.

For example, as shown in FIG. 11A, the plurality of light-emitting elements includes Q light-emitting elements L1-LQ, and each group of second voltage lines includes Q second voltage lines. For example, a q-th second voltage line of the Q second voltage lines is connected to q light-emitting elements respectively electrically connected to respective pixel drive chips in the pixel circuits of the corresponding row, and q is an integer greater than 0 and less than or equal to N. For example, a first light-emitting element L1 connected to a first pixel drive chip in the first row and a first light-emitting element L1 connected to a second pixel drive chip in the first row are both connected to a first second voltage line VDD-1 in the first group, a second light-emitting element L1 connected to the first pixel drive chip in the first row and a second light-emitting element L1 connected to the second pixel drive chip in the first row are both connected to the second voltage line VDD1-2 of the first group, and so on.

For example, in this example, the electronic substrate 100 further includes a voltage control circuit (not shown in the figure), the voltage control circuit is connected to the plurality of groups of second voltage lines VDD, and is configured to apply a timing sequence (for example, the timing sequence of the clock signal) of currents corresponding to the corresponding data signals to the Q light-emitting elements connected to respective pixel drive chips according to the respective pixel drive chips and to sequentially apply the second voltages to the Q second voltage lines in each group of second voltage lines, so as to drive the Q light-emitting elements to sequentially emit light according to the corresponding data signals. For example, during the non-light-emitting phase, the second voltage lines are disconnected from the voltage control circuit, that is, the respective second voltage lines are kept in a floating state or connected to large resistors respectively to prevent the light-emitting elements from emitting light. For example, the timing sequence for sending the data signals corresponding to the Q light-emitting elements to the Q light-emitting elements can be controlled by a clock signal, at the same time, the voltage control circuit controls the second voltage lines respectively connected to the Q light-emitting elements to provide corresponding voltages according to the clock signal, so that in the case where the data signal corresponding to the q-th light-emitting element among the Q light-emitting elements is displayed, and the second voltage can be controlled to be applied to the q-th second voltage line connected to the q-th light-emitting element. For example, the timing sequence of the clock signal is provided by a peripheral circuit, such as a timing controller (not shown in the figure). For example, the timing controller is configured to provide the clock signal to the voltage control circuit in the electronic substrate, so that the voltage control circuit controls the timing sequence for sending the second voltage to each second voltage line according to the clock signal, thereby achieving the display of the electronic substrate. Through this connection and control method, it is possible to avoid that in the case where the pixel drive chip has only one second terminal, the Q light-emitting elements connected to the pixel drive chip emit the same light.

Assuming that Q data signals that are in one-to-one correspondence to Q light-emitting elements are stored in the pixel drive chip, for example, the first light-emitting element L1 emits light according to the first data signal, the second light-emitting element L2 emits light according to the second data signal, and so on, the Q-th light-emitting element LQ emits light according to the Q-th data signal. However, because the Q light-emitting elements are all connected to the pixel drive chip 122 through one first signal terminal P1 or one second signal terminal P2, respective currents corresponding to the data signals stored in the pixel drive chip 122 will flow through the Q light-emitting elements at the same time. Therefore, in order to enable the Q light-emitting elements respectively emit light corresponding to the corresponding data signals, the second voltage may be applied row by row to the Q second voltage lines of the first group. For example, in the case where a current corresponding to the first data signal is applied to Q light-emitting elements, in order to enable the first light-emitting element L1 emit the corresponding light, in this case, the second voltage is applied to the first second voltage line VDD1-1 of the first group connected to the first light-emitting element L1, so as to form a path at the first light-emitting element L1; in the case where a current corresponding to the second data signal is applied to the Q light-emitting elements, in order to enable the second light-emitting element L2 emit the corresponding light, in this case, the second voltage is applied to the second voltage line VDD1-2 of the first group connected to the second light-emitting element L2, and so on. Therefore, by controlling the timing sequence of the second voltages applied to respective second voltage lines in each group, respective light-emitting elements of each pixel drive chip can be controlled to emit light of corresponding gray scales, respectively.

For example, as shown in FIG. 11B, after pixel units in one row have pre-stored their corresponding data signals, the second voltage line corresponding to the row of pixel circuits provides a second voltage to the second electrodes of the light-emitting elements included in the row of pixel circuits, and therefore, the light-emitting elements emit light row by row and display the pre-stored image data, that is, in a display phase of a current frame of image, the data signal is stored row by row and displayed row by row. This kind of work sequence can reduce display delay.

For example, in the first phase t1, the first switch control line GL1 of the first row provides a high level, and the switch transistor T is turned on to write the input signal into the pixel drive chip of the first row.

In the second phase t2, the first group of second voltage lines VDD1-1 to VDD1-Q connected to the second electrodes of the light-emitting elements in the first row of pixel units provides the second voltages row by row. Therefore, the light-emitting elements in the first row of pixel circuits emit light row by row.

Next, the first switch control line GL2 in the second row provides a high level, and the second group of second voltage lines VDD2-1 to VDD2-Q connected to the second electrodes of the light-emitting elements in the second row of pixel units provides the second voltages row by row. Therefore, the light-emitting elements in the second row of pixel circuits emit light row by row, and so on.

For example, each of the at least one light-emitting element L includes a first electrode and a second electrode, for example, the embodiments of the present disclosure are all described by adopting a common anode connection mode for each row of light-emitting elements. In this case, the first electrode of the light-emitting element is an anode and the second electrode of the light-emitting element is a cathode. It should be noted that in other examples, each row of light-emitting elements can also adopt a common cathode connection mode (as shown in FIG. 2, FIG. 2 is the case where each pixel drive chip is connected to only one light-emitting element, and the embodiments of the present disclosure are not limited to this case), in this case, the first electrode of the light-emitting element is the cathode and the second electrode of the light-emitting element is the anode. The details may be determined according to actual conditions, and the embodiments of the present disclosure are not limited to this case. In the case where the common cathode connection mode is adopted, its working principle and connection mode are similar to the connection mode and working principle of the common anode connection mode provided in the embodiments of the present disclosure, only the second voltage needs to be changed to a corresponding low level, and similar portions will not be repeated here.

Transistors used in at least one embodiment of the present disclosure may be thin film transistors or field effect transistors or other switch elements with the same characteristics, in the embodiments described in the present disclosure, thin film transistors are used as an example for description. A source electrode and a drain electrode of the transistor used herein may be symmetrical in structure, so the source electrode and the drain electrode of the transistor may have no difference in structure. In the embodiments of the present disclosure, in order to distinguish two electrodes of the transistor apart from a gate electrode, one of the two electrodes is directly referred to as a first electrode, and the other of the two electrodes is referred to as a second electrode. In addition, the transistors may be classified into N-type transistors and P-type transistors according to the characteristics of the transistors. In the case where the transistor is a P-type transistor, the turn-on voltage is a low-level voltage, the turn-off voltage is a high-level voltage; in the case where the transistor is an N-type transistor, the turn-on voltage is a high-level voltage, and the turn-off voltage is a low-level voltage.

In addition, the transistors in the embodiments of the present disclosure are described by taking N-type transistors as an example, in this case, the first electrode of the transistor is a drain electrode, and the second electrode is a source electrode. It should be noted that the present disclosure comprises but is not limited thereto. For example, one or more transistors in each selection switch provided by the embodiments of the present disclosure may also be P-type transistors, in this case, the first electrode of the transistor is a source electrode and the second electrode of the transistor is a drain electrode, so long as the respective electrodes of the selected type transistor are connected correspondingly with reference to the connection manner of the respective electrodes of the corresponding transistor in the embodiments of the present disclosure, and the corresponding voltage terminal is provided with a corresponding high voltage or low voltage. In the case where an N-type transistor is used, Iridium Gallium Zinc Oxide (IGZO) can be adopted as an active layer of a thin film transistor, compared to adopt low temperature poly silicon (LTPS) or amorphous silicon (for example, hydrogenation amorphous silicon) as an active layer of a thin film transistor, the size of the transistor can be effectively reduced and the leakage current can be prevented.

At least one embodiment of the present disclosure also provides a display device. FIG. 12 is a schematic diagram of a display device provided by at least one embodiment of the present disclosure. For example, as shown in FIG. 12, the display device 10 includes, for example, an electronic substrate 100 as shown in FIG. 2. The embodiments of the present disclosure are not limited to this case.

For example, as shown in FIG. 12, in some examples, the display device 10 further includes a timing controller 200 configured to provide a clock signal to the voltage control circuit 140 in the electronic substrate, so that the voltage control circuit 140 controls the timing sequence of sending the second voltage to each second voltage line according to the clock signal, so as to achieve the display of the electronic substrate.

For example, in other examples, as shown in FIG. 2, the display device 10 further includes a gate drive circuit 130 and a data drive circuit 140 disposed on the substrate 110.

For example, the electronic substrate 100 includes a switch control circuit 121, the switch control circuit 121 is connected to the pixel drive chip 122 and is configured to write a data signal (for example, an input signal) to the pixel drive chip 122 in response to a scan signal; the gate drive circuit 130 is electrically connected to the switch control circuits 121 of the pixel circuits in the plurality of rows through a plurality of gate lines GL, respectively, and is configured to respectively provide a plurality of scan signals to the switch control circuits 121 of the pixel circuits in the plurality of rows; the data drive circuit 140 is electrically connected to the switch control circuits 121 of the pixel circuits in the plurality of columns through a plurality of data lines DL, and is configured to respectively provide a plurality of data signals to the switch control circuits 121 of the pixel circuits in the plurality of columns.

For example, the switch control circuit 121 includes a switch transistor T, and a gate electrode of the switch transistor T is electrically connected to the gate drive circuit 130 through a connected gate line (for example, a first switch control line) GL to receive a scan signal, a first electrode of the switch transistor T is electrically connected to the data drive circuit 140 through the connected data line DL to receive a data signal, and a second electrode of the switch transistor T is connected to the first signal terminal P1 of the pixel drive chip 122. For example, the switch transistor T is turned on in response to the scan signal, and writes the data signal provided by the data drive circuit 140 into the pixel drive chip 122 for storage, so that the data signal is configured to drive the light-emitting element to emit light during the display phase.

For example, the gate drive circuit 130 may be implemented as a gate drive chip (IC) or directly prepared as a gate drive circuit (GOA) on the array substrate of the display device. For example, GOA includes a plurality of cascaded shift register units, and is configured to shift and output scan signals under the control of a trigger signal STV and a clock signal CLKA provided by a peripheral circuit (for example, a timing controller), and the specific cascade mode and the working principle of the GOA can refer to the design in the art, and will not be repeated here. The data drive circuit 140 can also refer to the design in the art, which will not be repeated here.

In this example, by integrating the gate drive circuit, the data drive circuit, the pixel drive chip, the light-emitting element L, etc. on the same array substrate, it can be achieved that the data signals are stored in the pixel drive chip by the AM (Active-matrix) driving method. For example, in the display phase, according to the actual situation, the second voltages provided by the second voltage lines are applied to the second electrodes of the light-emitting elements L at the same time or row by row, so that the pixel drive chip controls the current flowing through the light-emitting element according to the stored data signal, so as to drive the light-emitting element L to emit light according to a certain gray scale (data signal). That is, in the display phase, the driving of the light-emitting element still adopts a PM (Passive-Matrix, passive) driving method. Therefore, in the embodiments of the present disclosure, the AM driving method and the PM driving method can be combined to achieve the driving of the light-emitting element.

For example, in some examples, the electronic substrate 100 serves as an array substrate, the array substrate includes pixel units arranged in an array, and each of the pixel units includes a pixel drive chip and a light-emitting element. For example, in this example, the display device 10 may be a Mini LED display device or a miniature light-emitting diode display device, and the embodiments of the present disclosure are not limited to this case.

For example, in other examples, the electronic substrate 100 may be a liquid crystal electronic substrate. For example, in this example, the electronic substrate 100 serves as a backlight unit, the backlight unit includes a plurality of backlight partitions and is driven by a local dimming method, and each of the plurality of backlight partitions includes a pixel drive chip and a light-emitting element. For example, in this example, the pixel drive chip is configured to drive the light-emitting elements in each backlight partition to respectively emit light.

For example, in this example, the display device 10 may also be a liquid crystal display device, and the embodiments of the present disclosure are not limited to this case.

It should be noted that, for the sake of clarity and conciseness, all the constituent units of the display device 10 are not provided by the embodiments of the present disclosure. In order to achieve the basic functions of the display device 10, those skilled in the art can provide and set other structures not shown according to specific needs, and the embodiments of the present disclosure are not limited to this case.

Regarding the technical effects of the display device provided by the above-mentioned embodiments, reference may be made to the technical effects of the electronic substrate provided in the embodiments of the present disclosure, and similar portions will not be repeated here.

Figure 13:
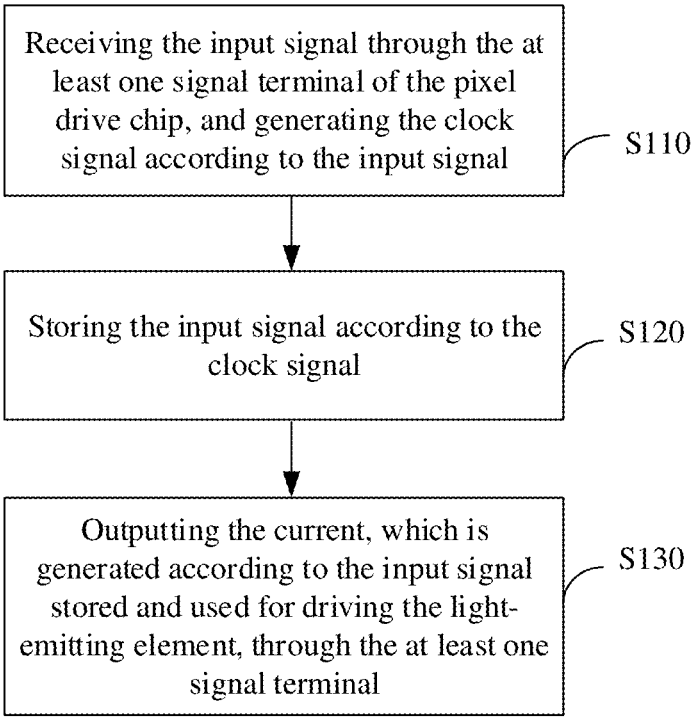
FIG. 13 is a flowchart of a driving method of an electronic substrate provided by at least one embodiment of the present disclosure.

At least one embodiment of the present disclosure also provides a driving method of an electronic substrate. FIG. 13 is a flowchart of a driving method of an electronic substrate provided by at least one embodiment of the present disclosure. As shown in FIG. 13, the driving method of the electronic substrate includes step S110-step S130.

Step S110: receiving the input signal through the at least one signal terminal of the pixel drive chip, and generating the clock signal according to the input signal.

Step S120: storing the input signal according to the clock signal.

Step S130: outputting the current, which is generated according to the input signal stored and used for driving the light-emitting element, through the at least one signal terminal.

For example, in some examples, step S110 includes: generating a data delay signal according to the input signal received, generating a data enable signal according to a difference between the data delay signal and the input signal, and determining the clock signal according to the data enable signal.

For step S120, for example, each shift register shifts and stores the aforementioned input signal in response to the rising edge of the clock signal CLK generated by the signal generation circuit 210. For specific description, reference may be made to the introduction shown in FIG. 5B.

For step S130, for example, in some examples, in the case where at least one signal terminal includes only one signal terminal, that is, in the example as shown in FIG. 3A, in the case where the at least one signal terminal includes only the first signal terminal P1, the pixel drive chip 122 further includes a multiplexing circuit 210, and the output circuit 230 can be indirectly connected to the at least one signal terminal P1 through the multiplexing circuit 240; as shown in FIG. 3B or FIG. 3C, in the case where the at least one signal terminal includes a first signal terminal P1 and a second signal terminal P2, the output circuit 230 may also be directly connected to the at least one signal terminal (i.e., the second signal terminal P2), and the embodiments of the present disclosure are not limited to this case. For example, the at least one signal terminal applies the current output by the output circuit 230 to the first electrode of the light-emitting element to drive the light-emitting element to emit light of corresponding gray scale. For specific description, reference may be made to the related descriptions in FIGS. 3A-11B, and similar portions will not be repeated here.

For example, in some examples, in the case where the at least one signal terminal includes only one signal terminal, that is, in the example as shown in FIG. 3A, in the case where the at least one signal terminal includes only the first signal terminal P1, the first signal terminal P1 is connected to the light-emitting element L, and in this case, the pixel drive chip is driven by the time-sharing driving technology. In this example, the driving method also includes: in a first period, the first signal terminal P1 providing the input signal INT to the signal generation circuit 210, and in a second period, the first signal terminal P1 outputting the current I generated by the output circuit 230 to the light-emitting element L. For specific description, reference may be made to the related descriptions in FIGS. 10A-10B, and similar portions will not be repeated here.

It should be noted that in the plurality of embodiments of the present disclosure, the flow of the driving method may include more or fewer operations, and these operations may be executed sequentially or in parallel. The driving method described above may be executed once, or may be executed several times according to predetermined conditions.

Regarding the technical effect of the driving method provided by the above-mentioned embodiments, reference may be made to the technical effect of the electronic substrate provided in the embodiment of the present disclosure, and similar portions will not be repeated here.

The following should be noted:

(1) Only the structures involved in the embodiments of the present disclosure are illustrated in the drawings of the embodiments of the present disclosure, and other structures can refer to usual designs.

(2) The embodiments and features in the embodiments of the present disclosure may be combined in case of no conflict to acquire new embodiments.

What have been described above merely are exemplary embodiments of the present disclosure, and not intended to define the scope of the present disclosure, and the scope of the present disclosure is determined by the appended claims.

What is claimed is:

1. An electronic substrate, comprising a pixel drive chip which comprises at least one signal terminal, a signal generation circuit, a data storage circuit, and an output circuit, wherein the at least one signal terminal is configured to be electrically connected to a light-emitting element;

the signal generation circuit is connected to the at least one signal terminal, and is configured to receive an input signal through the at least one signal terminal and generate a clock signal according to the input signal;

the data storage circuit is connected to the signal generation circuit and the output circuit, and is configured to receive the clock signal and store the input signal according to the clock signal; and the output circuit is configured to output a current, which is generated according to the input signal stored and used for driving the light-emitting element, through the at least one signal terminal, wherein the signal generation circuit is further configured to generate a data delay signal according to the input signal, generate a data enable signal according to a difference between the data delay signal and the input signal, and generate the clock signal according to the data enable signal, wherein the data storage circuit comprises a latch and a shift register;

the latch is connected to the signal generation circuit and is configured to store the input signal and the data enable signal; and the shift register is connected to the latch and the output circuit, and is configured to shift and store the input signal according to the clock signal, wherein a level of the input signal, a level of the data enable signal, and a level of the clock signal are higher than a bias voltage of a data signal and a bias voltage of a first power supply voltage.

2. The electronic substrate according to claim 1, wherein the input signal further comprises the first power supply voltage for driving the pixel drive chip.

3. The electronic substrate according to claim 2, wherein the at least one signal terminal comprises only a first signal terminal, the first signal terminal is connected to the light-emitting element, and the pixel drive chip further comprises a multiplexing circuit; and the multiplexing circuit is connected to the first signal terminal, the signal generation circuit, and the output circuit, and is configured to:

in a first period, connect the first signal terminal to the signal generation circuit to provide the input signal, and in a second period, connect the first signal terminal to the output circuit to output the current to the light-emitting element.

4. The electronic substrate according to claim 3, further comprising: a first switch control line, a data line, and a switch control circuit, wherein the switch control circuit is connected to the first switch control line, the data line, and the first signal terminal, and is configured to transmit the input signal provided by the data line to the first signal terminal in response to a first switch control signal provided by the first switch control line.

5. The electronic substrate according to claim 4, wherein the switch control circuit comprises a switch transistor; and a gate electrode of the switch transistor is connected to the first switch control line to receive the first switch control signal, a first electrode of the switch transistor is connected to the data line to receive the input signal, and a second electrode of the switch transistor is connected to the first signal terminal.

6. The electronic substrate according to claim 5, further comprising: a second switch control line, wherein the second switch control line is connected to the first signal terminal and the switch control circuit, so as to provide the first signal terminal with a second switch control signal, which is opposite to the first switch control signal, as the first power supply voltage in a case where the switch control circuit is turned off.

7. The electronic substrate according to claim 4, further comprising: a second switch control line, wherein the second switch control line is connected to the first signal terminal and the switch control circuit, so as to provide the first signal terminal with a second switch control signal, which is opposite to the first switch control signal, as the first power supply voltage in a case where the switch control circuit is turned off.

8. The electronic substrate according to claim 4, wherein the pixel drive chip further comprises a third signal terminal, and the third signal terminal is configured to provide the first power supply voltage to the pixel drive chip.

9. The electronic substrate according to claim 2, wherein the at least one signal terminal comprises a first signal terminal and a second signal terminal;

the first signal terminal is connected to the signal generation circuit to provide the input signal to the signal generation circuit; and the second signal terminal is connected to the output circuit and the light-emitting element to output the current output by the output circuit to the light-emitting element.

10. The electronic substrate according to claim 9, further comprising: a first switch control line, a data line, and a switch control circuit, wherein the switch control circuit is connected to the first switch control line, the data line, and the first signal terminal, and is configured to transmit the input signal provided by the data line to the first signal terminal in response to a first switch control signal provided by the first switch control line.

11. The electronic substrate according to claim 1, wherein the pixel drive chip further comprises a fourth signal terminal, and the fourth signal terminal is configured to provide a second power supply voltage to the pixel drive chip, and the second power supply voltage is opposite to the first power supply voltage.

12. A display device, comprising the electronic substrate according to claim 1, a gate drive circuit, and a data drive circuit, wherein the gate drive circuit is configured to provide a scan signal to the electronic substrate; and the data drive circuit is configured to provide the input signal to the electronic substrate.

13. The display device according to claim 12, wherein the electronic substrate serves as an array substrate, the array substrate comprises pixel units arranged in an array, and each of the pixel units comprises the pixel drive chip and the light-emitting element.

14. The display device according to claim 12, wherein the electronic substrate is used as a backlight unit, the backlight unit comprises a plurality of backlight partitions and is driven by a local dimming method, and each of the plurality of backlight partitions comprises the pixel drive chip and the light-emitting element.

15. A driving method of the electronic substrate according to claim 1, comprising:

receiving the input signal through the at least one signal terminal of the pixel drive chip, and generating the clock signal according to the input signal;

storing the input signal according to the clock signal; and outputting the current, which is generated according to the input signal stored and used for driving the light-emitting element, through the at least one signal terminal.

16. The driving method of the electronic substrate according to claim 15, wherein the generating the clock signal according to the input signal, comprises:

generating the data delay signal according to the input signal received, generating the data enable signal according to the difference between the data delay signal and the input signal, and determining the clock signal according to the data enable signal.

17. The driving method of the electronic substrate according to claim 15, wherein the at least one signal terminal only comprises a first signal terminal, the first signal terminal is connected to the light-emitting element, and the driving method further comprises:

in a first period, by the first signal terminal, providing the input signal to the signal generation circuit, and in a second period, by the first signal terminal, outputting the current generated by the output circuit to the light-emitting element.

* * * * *